US009207007B1

(12) United States Patent
Mowris

(10) Patent No.: US 9,207,007 B1
(45) Date of Patent: Dec. 8, 2015

(54) METHOD FOR CALCULATING TARGET TEMPERATURE SPLIT, TARGET SUPERHEAT, TARGET ENTHALPY, AND ENERGY EFFICIENCY RATIO IMPROVEMENTS FOR AIR CONDITIONERS AND HEAT PUMPS IN COOLING MODE

(71) Applicant: Robert J. Mowris, Olympic Valley, CA (US)

(72) Inventor: Robert J. Mowris, Olympic Valley, CA (US)

( * ) Notice: Subject to any disclaimer, the term of this patent is extended or adjusted under 35 U.S.C. 154(b) by 477 days.

(21) Appl. No.: 13/748,933

(22) Filed: Jan. 24, 2013

Related U.S. Application Data

(63) Continuation-in-part of application No. 12/896,727, filed on Oct. 1, 2010, now Pat. No. 8,583,384.

(60) Provisional application No. 61/256,993, filed on Nov. 1, 2009, provisional application No. 61/248,728, filed on Oct. 5, 2009.

(51) Int. Cl.
*F25B 49/00* (2006.01)
*F25B 45/00* (2006.01)

(52) U.S. Cl.
CPC ..... *F25B 49/00* (2013.01); *F25B 45/00* (2013.01); *F25B 2500/00* (2013.01); *F25B 2500/19* (2013.01)

(58) Field of Classification Search
CPC ..... F25B 49/005; F25B 45/00; F25B 2500/19
USPC ..... 702/45; 62/77, 127, 129, 149, 222, 498, 62/504
See application file for complete search history.

(56) References Cited

U.S. PATENT DOCUMENTS

| | | | | |
|---|---|---|---|---|
| 4,370,868 | A * | 2/1983 | Kim et al. | 62/504 |
| 5,209,076 | A * | 5/1993 | Kauffman et al. | 62/126 |
| 6,745,584 | B2 * | 6/2004 | Pham et al. | 62/228.3 |
| 7,201,006 | B2 * | 4/2007 | Kates | 62/129 |
| 7,500,368 | B2 * | 3/2009 | Mowris | 62/149 |
| 7,610,765 | B2 * | 11/2009 | Kang et al. | 62/127 |
| 8,024,938 | B2 * | 9/2011 | Rossi et al. | 62/127 |
| 8,583,384 | B2 * | 11/2013 | Mowris | 702/45 |
| 8,646,286 | B2 * | 2/2014 | Scherer et al. | 62/222 |
| 9,027,357 | B2 * | 5/2015 | Chang et al. | 62/77 |
| 2004/0111186 | A1 * | 6/2004 | Rossi et al. | 700/276 |
| 2004/0144106 | A1 * | 7/2004 | Douglas et al. | 62/127 |
| 2005/0126191 | A1 * | 6/2005 | Lifson et al. | 62/129 |
| 2006/0042276 | A1 * | 3/2006 | Doll et al. | 62/129 |
| 2006/0117767 | A1 * | 6/2006 | Mowris | 62/149 |
| 2006/0137370 | A1 * | 6/2006 | Kang et al. | 62/149 |
| 2007/0125102 | A1 * | 6/2007 | Concha et al. | 62/149 |
| 2007/0204635 | A1 * | 9/2007 | Tanaka et al. | 62/129 |
| 2010/0132399 | A1 * | 6/2010 | Mitra et al. | 62/498 |
| 2010/0139314 | A1 * | 6/2010 | Spatz | 62/498 |

* cited by examiner

*Primary Examiner* — Carol S Tsai
(74) *Attorney, Agent, or Firm* — Kenneth L. Green; Averill & Green

(57) ABSTRACT

A method is described for distinguishing non-condensables from refrigerant over-charge, and refrigerant restrictions from refrigerant under-charge of a cooling system and calculating an amount of refrigerant to be added or removed to the cooling system for optimal performance. Expanded target temperature split and target superheat tables and delta superheat tolerances are provided based on laboratory data and mathematical algorithms. The methods may apply to Fixed Expansion Valve (FXV) and Thermostatic Expansion Valve (TXV) systems and may include making and displaying a diagnostic recommendation regarding non-condensables, refrigerant restrictions, or refrigerant adjustment based upon measurements of return-air wetbulb and drybulb temperatures, condenser entering air temperature, refrigerant suction line temperature, refrigerant liquid line temperature, refrigerant vapor and liquid line pressures, and refrigerant superheat and subcooling temperatures.

20 Claims, 7 Drawing Sheets

Schematic Diagram of Air-conditioning System with Provision for Refrigerant Charge and Airflow Measurements According to an Embodiment of the Invention Schematic Diagram of Air-conditioning System with Provision for Refrigerant Charge and Airflow Measurements According to an Embodiment of the Invention Flow Chart to Differentiate Non Condensables from Over Charge for Non-TXV equipped Air Conditioners or Heat Pumps in Cooling Mode Flow Chart to Differentiate Non Condensables from Over Charge for TXV equipped Air Conditioners or Heat Pumps in Cooling Mode

Restriction Evaporator Saturation versus Condenser Entering Air Temperature

Flow Chart to Differentiate Refrigerant Restrictions from Under Charge for Non-TXV equipped Air Conditioners or Heat Pumps in Cooling Mode Flow Chart to Differentiate Refrigerant Restrictions from Under Charge for TXV equipped Air Conditioners or Heat Pumps in Cooling Mode

METHOD FOR CALCULATING TARGET TEMPERATURE SPLIT, TARGET SUPERHEAT, TARGET ENTHALPY, AND ENERGY EFFICIENCY RATIO IMPROVEMENTS FOR AIR CONDITIONERS AND HEAT PUMPS IN COOLING MODE

RELATED APPLICATIONS

The present application claims the priority of U.S. Provisional Patent Application Ser. No. 61/248,728 filed Oct. 5, 2009 and U.S. Provisional Patent Application Ser. No. 61/256,993 filed Nov. 1, 2009, and is a Continuation In Part of U.S. patent application Ser. No. 12/896,727 filed Oct. 1, 2010, which applications are incorporated in their entirety herein by reference.

FIELD OF THE INVENTION

The invention generally relates to air-conditioning systems and heat pump systems, especially in cooling mode.

BACKGROUND

Known methods for optimizing Air conditioning systems involve taking measurements of certain temperatures and pressures of a cooling system and determining if the system needs airflow adjustments or refrigerant added or removed. One significant deficiency to prior art methods is the target temperature split, defined as the target return air dry-bulb temperature minus the target supply air dry-bulb temperature, known look up tables are limited to return air dry-bulb temperatures between 70 and 84 degrees Fahrenheit. For return air dry-bulb temperatures between 60 and 69 degrees Fahrenheit, and return air dry-bulb temperatures between 77 and 84 degrees Fahrenheit, and return air wet-bulb temperatures between 50 and 58 degrees Fahrenheit, the target temperature split is undefined as shown in prior art Table 1. In the upper right corner of Table 1, the target temperature split does not exist since and the return wet-bulb temperature cannot exceed the return dry-bulb temperature and the relative humidity cannot be greater than 100 percent (under atmospheric conditions).

TABLE 1

Prior Art Target Temperature Split

| | | Return Air Wet-Bulb Temperature (° F.) | | | | | | | | | | | | | | |
|---|---|---|---|---|---|---|---|---|---|---|---|---|---|---|---|---|
| | | 50 | 51 | 52 | 53 | 54 | 55 | 56 | 57 | 58 | 59 | 60 | 61 | 62 | 63 | 64 |
| Return Air Dry-Bulb Temperature (° F.) | 60 | | | | | | | | | | | | Undefined Relative Humidity Cannot Exceed 100% | | | |
| | 61 | | | | | | | | | | | | | | | |
| | 62 | | | | | | | | | | | | | | | |
| | 63 | | | | | | | | | | | | | | | |
| | 64 | | | | Undefined Target Temperature Split | | | | | | | | | | | |
| | 65 | | | | | | | | | | | | | | | |
| | 66 | | | | | | | | | | | | | | | |
| | 67 | | | | | | | | | | | | | | | |
| | 68 | | | | | | | | | | | | | | | |
| | 69 | | | | | | | | | | | | | | | |
| | 70 | 20.9 | 20.7 | 20.6 | 20.4 | 20.1 | 19.9 | 19.5 | 19.1 | 18.7 | 18.2 | 17.7 | 17.2 | 16.5 | 15.9 | 15.2 |
| | 71 | 21.4 | 21.3 | 21.1 | 20.9 | 20.7 | 20.4 | 20.1 | 19.7 | 19.3 | 18.8 | 18.3 | 17.7 | 17.1 | 16.4 | 15.7 |
| | 72 | 21.9 | 21.8 | 21.7 | 21.5 | 21.2 | 20.9 | 20.6 | 20.2 | 19.8 | 19.3 | 18.8 | 18.2 | 17.6 | 17.0 | 16.3 |
| | 73 | 22.5 | 22.4 | 22.2 | 22.0 | 21.8 | 21.5 | 21.2 | 20.8 | 20.3 | 19.9 | 19.4 | 18.8 | 18.2 | 17.5 | 16.8 |
| | 74 | 23.0 | 22.9 | 22.8 | 22.6 | 22.3 | 22.0 | 21.7 | 21.3 | 20.9 | 20.4 | 19.9 | 19.3 | 18.7 | 18.1 | 17.4 |
| | 75 | 23.6 | 23.5 | 23.3 | 23.1 | 22.9 | 22.6 | 22.2 | 21.9 | 21.4 | 21.0 | 20.4 | 19.9 | 19.3 | 18.6 | 17.9 |
| | 76 | 24.1 | 24.0 | 23.9 | 23.7 | 23.4 | 23.1 | 22.8 | 22.4 | 22.0 | 21.5 | 21.0 | 20.4 | 19.8 | 19.2 | 18.5 |
| | 77 | | 24.6 | 24.4 | 24.2 | 24.0 | 23.7 | 23.3 | 22.9 | 22.5 | 22.0 | 21.5 | 21.0 | 20.4 | 19.7 | 19.0 |
| | 78 | | | | 24.7 | 24.5 | 24.2 | 23.9 | 23.5 | 23.1 | 22.6 | 22.1 | 21.5 | 20.9 | 20.2 | 19.5 |
| | 79 | | | | | | 24.8 | 24.4 | 24.0 | 23.6 | 23.1 | 22.6 | 22.1 | 21.4 | 20.8 | 20.1 |
| | 80 | | | | | | | 25.0 | 24.6 | 24.2 | 23.7 | 23.2 | 22.6 | 22.0 | 21.3 | 20.6 |
| | 81 | | Undefined Target Temperature Split | | | | | | 25.1 | 24.7 | 24.2 | 23.7 | 23.1 | 22.5 | 21.9 | 21.2 |
| | 82 | | | | | | | | | 25.2 | 24.8 | 24.2 | 23.7 | 23.1 | 22.4 | 21.7 |
| | 83 | | | | | | | | | | 25.3 | 24.8 | 24.2 | 23.6 | 23.0 | 22.3 |
| | 84 | | | | | | | | | | 25.9 | 25.2 | 24.8 | 24.2 | 23.5 | 22.8 |
| | | 50 | 51 | 52 | 53 | 54 | 55 | 56 | 57 | 58 | 59 | 60 | 61 | 62 | 63 | 64 |

| | | Return Air Wet-Bulb Temperature (° F.) | | | | | | | | | | | | |
|---|---|---|---|---|---|---|---|---|---|---|---|---|---|---|
| | | 65 | 66 | 67 | 68 | 69 | 70 | 71 | 72 | 73 | 74 | 75 | 76 | |
| Return Air Dry-Bulb Temperature (° F.) | 60 | | | | | | | | | | | | | 60 |
| | 61 | | | | | | | | | | | | | 61 |
| | 62 | | | | | | | | | | | | | 62 |
| | 63 | | | | | | | | | | | | | 63 |
| | 64 | | | | | | | | Undefined Relative Humidity Cannot Exceed 100% | | | | | 64 |
| | 65 | | | | | | | | | | | | | 65 |
| | 66 | | | | | | | | | | | | | 66 |
| | 67 | Undefined Target Temperature Split | | | | | | | | | | | | 67 |
| | 68 | | | | | | | | | | | | | 68 |
| | 69 | | | | | | | | | | | | | 69 |
| | 70 | 14.4 | 13.7 | 12.8 | 11.9 | 11.0 | 10.0 | | | | | | | 70 |
| | 71 | 15.0 | 14.2 | 13.4 | 12.5 | 11.5 | 10.6 | 9.5 | | | | | | 71 |
| | 72 | 15.5 | 14.7 | 13.9 | 13.0 | 12.1 | 11.1 | 10.1 | 9.0 | | | | | 72 |
| | 73 | 16.1 | 15.3 | 14.4 | 13.6 | 12.6 | 11.7 | 10.6 | 9.6 | 8.5 | | | | 73 |
| | 74 | 16.6 | 15.8 | 15.0 | 14.1 | 13.2 | 12.2 | 11.2 | 10.1 | 9.0 | 7.8 | | | 74 |

TABLE 1-continued

| Prior Art Target Temperature Split | | | | | | | | | | | | | |
|---|---|---|---|---|---|---|---|---|---|---|---|---|---|
| 75 | 17.2 | 16.4 | 15.5 | 14.7 | 13.7 | 12.7 | 11.7 | 10.7 | 9.5 | 8.4 | 7.2 | | 75 |
| 76 | 17.7 | 16.9 | 16.1 | 15.2 | 14.3 | 13.3 | 12.3 | 11.2 | 10.1 | 8.9 | 7.7 | 6.5 | 76 |
| 77 | 18.3 | 17.5 | 16.6 | 15.7 | 14.8 | 13.8 | 12.8 | 11.7 | 10.6 | 9.5 | 8.3 | 7.0 | 77 |
| 78 | 18.8 | 18.0 | 17.2 | 16.3 | 15.4 | 14.4 | 13.4 | 12.3 | 11.2 | 10.0 | 8.8 | 7.6 | 78 |
| 79 | 19.3 | 18.5 | 17.7 | 16.8 | 15.9 | 14.9 | 13.9 | 12.8 | 11.7 | 10.6 | 9.4 | 8.1 | 79 |
| 80 | 19.9 | 19.1 | 18.3 | 17.4 | 16.4 | 15.5 | 14.4 | 13.4 | 12.3 | 11.1 | 9.9 | 8.7 | 80 |
| 81 | 20.4 | 19.6 | 18.8 | 17.9 | 17.0 | 16.0 | 15.0 | 13.9 | 12.8 | 11.7 | 10.4 | 9.2 | 81 |
| 82 | 21.0 | 20.2 | 19.3 | 18.5 | 17.5 | 16.6 | 15.5 | 14.5 | 13.4 | 12.2 | 11.0 | 9.7 | 82 |
| 83 | 21.5 | 20.7 | 19.9 | 19.0 | 18.1 | 17.1 | 16.1 | 15.0 | 13.9 | 12.7 | 11.5 | 10.3 | 83 |
| 84 | 22.1 | 21.3 | 20.4 | 19.5 | 18.6 | 17.6 | 16.6 | 15.6 | 14.4 | 13.3 | 12.5 | 10.8 | 84 |
| | 65 | 66 | 67 | 68 | 69 | 70 | 71 | 72 | 73 | 74 | 75 | 76 | |

Another significant drawback is the target superheat temperature, defined as the refrigerant suction line temperature minus the refrigerant evaporator saturation temperature, is limited to condenser air dry-bulb temperatures of 55 to 65 degrees Fahrenheit at return air dry-bulb temperature of 55 degrees Fahrenheit and condenser air dry-bulb temperature of 115 degrees Fahrenheit at return air dry-bulb temperature of 69 to 76 degrees Fahrenheit. For condenser air dry-bulb temperatures between 65 and 115 degrees Fahrenheit and return air dry-bulb temperatures between 55 and 69 degrees Fahrenheit the target superheat is undefined as shown in prior art Table 2.

TABLE 2

| Prior Target Superheat | | | | | | | | | | | | | | | |
|---|---|---|---|---|---|---|---|---|---|---|---|---|---|---|---|
| | | Return Air Wet-Bulb Temperature (° F.) | | | | | | | | | | | | | |
| | | 50 | 51 | 52 | 53 | 54 | 55 | 56 | 57 | 58 | 59 | 60 | 61 | 62 | 63 |
| Condenser Air Dry-Bulb Temperature (° F.) | 55 | 8.8 | 10.1 | 11.5 | 12.8 | 14.2 | 15.6 | 17.1 | 18.5 | 20 | 21.5 | 23.1 | 24.6 | 26.2 | 27.8 |
| | 56 | 8.6 | 9.9 | 11.2 | 12.6 | 14 | 15.4 | 16.8 | 18.2 | 19.7 | 21.2 | 22.7 | 24.2 | 25.7 | 27.3 |
| | 57 | 8.3 | 9.6 | 11 | 12.3 | 13.7 | 15.1 | 16.5 | 17.9 | 19.4 | 20.8 | 22.3 | 23.8 | 25.3 | 26.8 |
| | 58 | 7.9 | 9.3 | 10.6 | 12 | 13.4 | 14.8 | 16.2 | 17.6 | 19 | 20.4 | 21.9 | 23.3 | 24.8 | 26.3 |
| | 59 | 7.5 | 8.9 | 10.2 | 11.6 | 13 | 14.4 | 15.8 | 17.2 | 18.6 | 20 | 21.4 | 22.9 | 24.3 | 25.7 |
| | 60 | 7 | 8.4 | 9.8 | 11.2 | 12.6 | 14 | 15.4 | 16.8 | 18.2 | 19.6 | 21 | 22.4 | 23.8 | 25.2 |
| | 61 | 6.5 | 7.9 | 9.3 | 10.7 | 12.1 | 13.5 | 14.9 | 16.3 | 17.7 | 19.1 | 20.5 | 21.9 | 23.3 | 24.7 |
| | 62 | 6 | 7.4 | 8.8 | 10.2 | 11.7 | 13.1 | 14.5 | 15.9 | 17.3 | 18.7 | 20.1 | 21.4 | 22.8 | 24.2 |
| | 63 | 5.3 | 6.8 | 8.3 | 9.7 | 11.1 | 12.6 | 14 | 15.4 | 16.8 | 18.2 | 19.6 | 20.9 | 22.3 | 23.6 |
| | 64 | | 6.1 | 7.6 | 9.1 | 10.6 | 12 | 13.5 | 14.9 | 16.3 | 17.7 | 19 | 20.4 | 21.7 | 23.1 |
| | 65 | | 5.4 | 7 | 8.5 | 10 | 11.5 | 12.9 | 14.3 | 15.8 | 17.1 | 18.5 | 19.9 | 21.2 | 22.5 |
| | 66 | | | 6.3 | 7.8 | 9.3 | 10.8 | 12.3 | 13.8 | 15.2 | 16.6 | 18 | 19.3 | 20.7 | 22 |
| | 67 | | | 5.5 | 7.1 | 8.7 | 10.2 | 11.7 | 13.2 | 14.6 | 16 | 17.4 | 18.8 | 20.1 | 21.4 |
| | 68 | | | | 6.3 | 8 | 9.5 | 11.1 | 12.6 | 14 | 15.5 | 16.8 | 18.2 | 19.5 | 20.8 |
| | 69 | | | | 5.5 | 7.2 | 8.8 | 10.4 | 11.9 | 13.4 | 14.8 | 16.3 | 17.6 | 19 | 20.3 |
| | 70 | | | | | 6.4 | 8.1 | 9.7 | 11.2 | 12.7 | 14.2 | 15.7 | 17 | 18.4 | 19.7 |
| | 71 | | | | | 5.6 | 7.3 | 8.9 | 10.5 | 12.1 | 13.6 | 15 | 16.4 | 17.8 | 19.1 |
| | 72 | | | | | | 6.4 | 8.1 | 9.8 | 11.4 | 12.9 | 14.4 | 15.8 | 17.2 | 18.5 |
| | 73 | | | | | | 5.6 | 7.3 | 9 | 10.7 | 12.2 | 13.7 | 15.2 | 16.6 | 17.9 |
| | 74 | | | | | | | 6.5 | 8.2 | 9.9 | 11.5 | 13.1 | 14.5 | 15.9 | 17.3 |
| | 75 | | | | | | | 5.6 | 7.4 | 9.2 | 10.8 | 12.4 | 13.9 | 15.3 | 16.7 |
| | 76 | | | | | | | | 6.6 | 8.4 | 10.1 | 11.7 | 13.2 | 14.7 | 16.1 |
| | 77 | | | | | | | | 5.7 | 7.5 | 9.3 | 11 | 12.5 | 14 | 15.4 |
| | 78 | | | | | | | | | 6.7 | 8.5 | 10.2 | 11.8 | 13.4 | 14.8 |
| | 79 | | | | | | | | | 5.9 | 7.7 | 9.5 | 11.1 | 12.7 | 14.2 |
| | 80 | | | | | | | | | | 6.9 | 8.7 | 10.4 | 12 | 13.5 |
| | 81 | | | | | | | | | | 6 | 7.9 | 9.7 | 11.3 | 12.9 |
| | 82 | | | | | | | | | | 5.2 | 7.1 | 8.9 | 10.6 | 12.2 |
| | 83 | | | | | | | | | | | 6.3 | 8.2 | 9.9 | 11.6 |
| | 84 | | | | | | | | | | | 5.5 | 7.4 | 9.2 | 10.9 |
| | 85 | | | | | | | | | | | | 6.6 | 8.5 | 10.3 |
| | 86 | | | | | | | | | | | | 5.8 | 7.8 | 9.6 |
| | 87 | | | | | | | | | | | | 5 | 7 | 8.9 |
| | 88 | | | | | | | | | | | | | 6.3 | 8.2 |
| | 89 | | | | Undefined Target | | | | | | | | | 5.5 | 7.5 |
| | 90 | | | | Superheat | | | | | | | | | | 6.8 |
| | 91 | | | | | | | | | | | | | | 6.1 |
| | 92 | | | | | | | | | | | | | | 5.4 |
| | 93 | | | | | | | | | | | | | | |
| | 94 | | | | | | | | | | | | | | |
| | 95 | | | | | | | | | | | | | | |
| | 96 | | | | | | | | | | | | | | |
| | 97 | | | | | | | | | | | | | | |
| | 98 | | | | | | | | | | | | | | |
| | 99 | | | | | | | | | | | | | | |
| | 100 | | | | | | | | | | | | | | |

TABLE 2-continued

| | | Prior Target Superheat | | | | | | | | | | | | | |
|---|---|---|---|---|---|---|---|---|---|---|---|---|---|---|---|
| | 101 | | | | | | | | | | | | | | |
| | 102 | | | | | | | | | | | | | | |
| | 103 | | | | | | | | | | | | | | |
| | 104 | | | | | | | | | | | | | | |
| | 105 | | | | | | | | | | | | | | |
| | 106 | | | | | | | | | | | | | | |
| | 107 | | | | | | | | | | | | | | |
| | 108 | | | | | | | | | | | | | | |
| | 109 | | | | | | | | | | | | | | |
| | 110 | | | | | | | | | | | | | | |
| | 111 | | | | | | | | | | | | | | |
| | 112 | | | | | | | | | | | | | | |
| | 113 | | | | | | | | | | | | | | |
| | 114 | | | | | | | | | | | | | | |
| | 115 | | | | | | | | | | | | | | |
| | | 50 | 51 | 52 | 53 | 54 | 55 | 56 | 57 | 58 | 59 | 60 | 61 | 62 | 63 |
| | | Return Air Wet-Bulb Temperature (° F.) | | | | | | | | | | | | | |
| | | 64 | 65 | 66 | 67 | 68 | 69 | 70 | 71 | 72 | 73 | 74 | 75 | 76 | |
| Condenser Air Dry-Bulb Temperature (° F.) | 55 | 29.4 | 31 | 32.4 | 33.8 | 35.1 | 36.4 | 37.7 | 39 | 40.2 | 41.5 | 42.7 | 43.9 | 45 | 55 |
| | 56 | 28.9 | 30.5 | 31.8 | 33.2 | 34.6 | 35.9 | 37.2 | 38.5 | 39.7 | 41 | 42.2 | 43.4 | 44.6 | 56 |
| | 57 | 28.3 | 29.9 | 31.3 | 32.6 | 34 | 35.3 | 36.7 | 38 | 39.2 | 40.5 | 41.7 | 43 | 44.2 | 57 |
| | 58 | 27.8 | 29.3 | 30.7 | 32.1 | 33.5 | 34.8 | 36.1 | 37.5 | 38.7 | 40 | 41.3 | 42.5 | 43.7 | 58 |
| | 59 | 27.2 | 28.7 | 30.1 | 31.5 | 32.9 | 34.3 | 35.6 | 36.9 | 38.3 | 39.5 | 40.8 | 42.1 | 43.3 | 59 |
| | 60 | 26.6 | 28.1 | 29.6 | 31 | 32.4 | 33.7 | 35.1 | 36.4 | 37.8 | 39.1 | 40.4 | 41.6 | 42.9 | 60 |
| | 61 | 26.1 | 27.5 | 29 | 30.4 | 31.8 | 33.2 | 34.6 | 35.9 | 37.3 | 38.6 | 39.9 | 41.2 | 42.4 | 61 |
| | 62 | 25.5 | 27 | 28.4 | 29.9 | 31.3 | 32.7 | 34.1 | 35.4 | 36.8 | 38.1 | 39.4 | 40.7 | 42 | 62 |
| | 63 | 25 | 26.4 | 27.8 | 29.3 | 30.7 | 32.2 | 33.6 | 34.9 | 36.3 | 37.7 | 39 | 40.3 | 41.6 | 63 |
| | 64 | 24.4 | 25.8 | 27.3 | 28.7 | 30.2 | 31.6 | 33 | 34.4 | 35.8 | 37.2 | 38.5 | 39.9 | 41.2 | 64 |
| | 65 | 23.8 | 25.2 | 26.7 | 28.2 | 29.7 | 31.1 | 32.5 | 33.9 | 35.3 | 36.7 | 38.1 | 39.4 | 40.8 | 65 |
| | 66 | 23.2 | 24.6 | 26.1 | 27.6 | 29.1 | 30.6 | 32 | 33.4 | 34.9 | 36.3 | 37.6 | 39 | 40.4 | 66 |
| | 67 | 22.7 | 24.1 | 25.6 | 27.1 | 28.6 | 30.1 | 31.5 | 33 | 34.4 | 35.8 | 37.2 | 38.6 | 39.9 | 67 |
| | 68 | 22.1 | 23.5 | 25 | 26.5 | 28 | 29.5 | 31 | 32.5 | 33.9 | 35.3 | 36.8 | 38.1 | 39.5 | 68 |
| | 69 | 21.5 | 22.9 | 24.4 | 26 | 27.5 | 29 | 30.5 | 32 | 33.4 | 34.9 | 36.3 | 37.7 | 39.1 | 69 |
| | 70 | 20.9 | 22.3 | 23.9 | 25.4 | 27 | 28.5 | 30 | 31.5 | 33 | 34.4 | 35.9 | 37.3 | 38.7 | 70 |
| | 71 | 20.3 | 21.7 | 23.3 | 24.9 | 26.4 | 28 | 29.5 | 31 | 32.5 | 34 | 35.4 | 36.9 | 38.3 | 71 |
| | 72 | 19.7 | 21.2 | 22.8 | 24.3 | 25.9 | 27.4 | 29 | 30.5 | 32 | 33.5 | 35 | 36.5 | 37.9 | 72 |
| | 73 | 19.2 | 20.6 | 22.2 | 23.8 | 25.4 | 26.9 | 28.5 | 30 | 31.5 | 33.1 | 34.6 | 36 | 37.5 | 73 |
| | 74 | 18.6 | 20 | 21.6 | 23.2 | 24.8 | 26.4 | 28 | 29.5 | 31.1 | 32.6 | 34.1 | 35.6 | 37.1 | 74 |
| | 75 | 18 | 19.4 | 21.1 | 22.7 | 24.3 | 25.9 | 27.5 | 29.1 | 30.6 | 32.2 | 33.7 | 35.2 | 36.7 | 75 |
| | 76 | 17.4 | 18.9 | 20.5 | 22.1 | 23.8 | 25.4 | 27 | 28.6 | 30.1 | 31.7 | 33.3 | 34.8 | 36.3 | 76 |
| | 77 | 16.8 | 18.3 | 20 | 21.6 | 23.2 | 24.9 | 26.5 | 28.1 | 29.7 | 31.3 | 32.8 | 34.4 | 36 | 77 |
| | 78 | 16.2 | 17.7 | 19.4 | 21.1 | 22.7 | 24.4 | 26 | 27.6 | 29.2 | 30.8 | 32.4 | 34 | 35.6 | 78 |
| | 79 | 15.6 | 17.1 | 18.8 | 20.5 | 22.2 | 23.8 | 25.5 | 27.1 | 28.8 | 30.4 | 32 | 33.6 | 35.2 | 79 |
| | 80 | 15 | 16.6 | 18.3 | 20 | 21.7 | 23.3 | 25 | 26.7 | 28.3 | 29.9 | 31.6 | 33.2 | 34.8 | 80 |
| | 81 | 14.3 | 16 | 17.7 | 19.4 | 21.1 | 22.8 | 24.5 | 26.2 | 27.9 | 29.5 | 31.2 | 32.8 | 34.4 | 81 |
| | 82 | 13.7 | 15.4 | 17.2 | 18.9 | 20.6 | 22.3 | 24 | 25.7 | 27.4 | 29.1 | 30.7 | 32.4 | 34 | 82 |
| | 83 | 13.1 | 14.9 | 16.6 | 18.4 | 20.1 | 21.8 | 23.5 | 25.2 | 26.9 | 28.6 | 30.3 | 32 | 33.7 | 83 |
| | 84 | 12.5 | 14.3 | 16.1 | 17.8 | 19.6 | 21.3 | 23 | 24.8 | 26.5 | 28.2 | 29.9 | 31.6 | 33.3 | 84 |
| | 85 | 11.9 | 13.7 | 15.5 | 17.3 | 19 | 20.8 | 22.6 | 24.3 | 26 | 27.8 | 29.5 | 31.2 | 32.9 | 85 |
| | 86 | 11.3 | 13.2 | 15 | 16.7 | 18.5 | 20.3 | 22.1 | 23.8 | 25.6 | 27.3 | 29.1 | 30.8 | 32.6 | 86 |
| | 87 | 10.6 | 12.6 | 14.4 | 16.2 | 18 | 19.8 | 21.6 | 23.4 | 25.1 | 26.9 | 28.7 | 30.4 | 32.2 | 87 |
| | 88 | 10 | 12 | 13.9 | 15.7 | 17.5 | 19.3 | 21.1 | 22.9 | 24.7 | 26.5 | 28.3 | 30.1 | 31.8 | 88 |
| | 89 | 9.4 | 11.5 | 13.3 | 15.1 | 17 | 18.8 | 20.6 | 22.4 | 24.3 | 26.1 | 27.9 | 29.7 | 31.5 | 89 |
| | 90 | 8.8 | 10.9 | 12.8 | 14.6 | 16.5 | 18.3 | 20.1 | 22 | 23.8 | 25.6 | 27.5 | 29.3 | 31.1 | 90 |
| | 91 | 8.1 | 10.3 | 12.2 | 14.1 | 15.9 | 17.8 | 19.7 | 21.5 | 23.2 | 25.2 | 27.1 | 28.9 | 30.8 | 91 |
| | 92 | 7.5 | 9.8 | 11.7 | 13.5 | 15.4 | 17.3 | 19.2 | 21.1 | 22.9 | 24.8 | 26.7 | 28.5 | 30.4 | 92 |
| | 93 | 6.8 | 9.2 | 11.1 | 13 | 14.9 | 16.8 | 18.7 | 20.6 | 22.5 | 24.4 | 26.3 | 28.2 | 30.1 | 93 |
| | 94 | 6.2 | 8.7 | 10.6 | 12.5 | 14.4 | 16.3 | 18.2 | 20.2 | 22.1 | 24 | 25.9 | 27.8 | 29.7 | 94 |
| | 95 | 5.6 | 8.1 | 10 | 12 | 13.9 | 15.8 | 17.8 | 19.7 | 21.6 | 23.6 | 25.5 | 27.4 | 29.4 | 95 |
| | 96 | | 7.5 | 9.5 | 11.4 | 13.4 | 15.3 | 17.3 | 19.2 | 21.2 | 23.2 | 25.1 | 27.1 | 29 | 96 |
| | 97 | | 7 | 8.9 | 10.9 | 12.9 | 14.9 | 16.8 | 18.8 | 20.8 | 22.7 | 24.7 | 26.7 | 28.7 | 97 |
| | 98 | | 6.4 | 8.4 | 10.4 | 12.4 | 14.4 | 16.4 | 18.3 | 20.3 | 22.3 | 24.3 | 26.3 | 28.3 | 98 |
| | 99 | | 5.8 | 7.9 | 9.9 | 11.9 | 13.9 | 15.9 | 17.9 | 19.9 | 21.9 | 24 | 26 | 28 | 99 |
| | 100 | | 5.3 | 7.3 | 9.3 | 11.4 | 13.4 | 15.4 | 17.5 | 19.5 | 21.5 | 23.6 | 25.6 | 27.7 | 100 |
| | 101 | | | 6.8 | 8.8 | 10.9 | 12.9 | 15 | 17 | 19.1 | 21.1 | 23.2 | 25.3 | 27.3 | 101 |
| | 102 | | | 6.2 | 8.3 | 10.4 | 12.4 | 14.5 | 16.6 | 18.6 | 20.7 | 22.8 | 24.9 | 27 | 102 |
| | 103 | | | 5.7 | 7.8 | 9.9 | 11.9 | 14 | 16.1 | 18.2 | 20.3 | 22.4 | 24.5 | 26.7 | 103 |
| | 104 | | | 5.2 | 7.2 | 9.3 | 11.5 | 13.6 | 15.7 | 17.8 | 19.9 | 22.1 | 24.2 | 26.3 | 104 |
| | 105 | | | | 6.7 | 8.8 | 11 | 13.1 | 15.2 | 17.4 | 19.5 | 21.7 | 23.8 | 26 | 105 |
| | 106 | | | | 6.2 | 8.3 | 10.5 | 12.6 | 14.8 | 17 | 19.1 | 21.3 | 23.5 | 25.7 | 106 |
| | 107 | | | | 5.7 | 7.9 | 10 | 12.2 | 14.4 | 16.6 | 18.7 | 21 | 23.2 | 25.4 | 107 |
| | 108 | Undefined | | | 5.2 | 7.4 | 9.5 | 11.7 | 13.9 | 16.1 | 18.4 | 20.6 | 22.8 | 25.1 | 108 |
| | 109 | Target | | | | 6.9 | 9.1 | 11.3 | 13.5 | 15.7 | 18 | 20.2 | 22.5 | 24.7 | 109 |
| | 110 | Superheat | | | | 6.4 | 8.6 | 10.8 | 13.1 | 15.3 | 17.6 | 19.9 | 22.1 | 24.4 | 110 |

TABLE 2-continued

| Prior Target Superheat | | | | | | | | | | | | | | |
|---|---|---|---|---|---|---|---|---|---|---|---|---|---|---|
| 111 | | | | | 5.9 | 8.1 | 10.4 | 12.6 | 14.9 | 17.2 | 19.5 | 21.8 | 24.1 | 111 |
| 112 | | | | | 5.4 | 7.6 | 9.9 | 12.2 | 14.5 | 16.8 | 19.1 | 21.5 | 23.8 | 112 |
| 113 | | | | | | 7.2 | 9.5 | 11.8 | 14.1 | 16.4 | 18.8 | 21.1 | 23.5 | 113 |
| 114 | | | | | | 6.7 | 9 | 11.4 | 13.7 | 16.1 | 18.4 | 20.8 | 23.2 | 114 |
| 115 | | | | | | 6.2 | 8.6 | 10.9 | 13.3 | 15.7 | 18.1 | 20.5 | 22.9 | 115 |
| | 64 | 65 | 66 | 67 | 68 | 69 | 70 | 71 | 72 | 73 | 74 | 75 | 76 | |

In many hot and dry climates throughout the world air conditioning is required to cool interior spaces to maintain indoor comfort. In hot and dry climates when technicians diagnose target temperature split for air conditioners or heat pumps in cooling mode and the return air dry-bulb temperature is in the undefined region using prior art methods, it is impossible to obtain target temperature split to diagnose proper airflow. In hot and dry climates when technicians diagnose target superheat for air conditioners or heat pumps in cooling mode with Fixed Expansion Valve (FXV) systems and the condenser air dry-bulb temperature and return air wet-bulb temperature are in the undefined region using prior art methods, it is impossible to obtain target temperature split to diagnose proper refrigerant charge.

Undefined target temperature split and undefined target superheat values cause technicians to improperly diagnose proper temperature split and superheat leading to significant performance problems that can cause the following problems: insufficient airflow, insufficient cooling capacity, liquid refrigerant entering the compressor, excessive mechanical vibration and noise, premature failure of the compressor, reduced energy efficiency performance, and increased electricity consumption.

Further, there are no prior art methods to differentiate non-condensables from over-charge, and restrictions from under-charge, and without this knowledge, refrigerant would be incorrectly removed from systems with non-condensables present, and added to systems with restrictions.

Correcting non-condensables saves electricity by removing air and/or water vapor from the system to improve heat transfer from the condenser and reduce system pressure and operational time which reduces electric power usage and prolongs the life of air conditioners. Correcting restrictions saves electricity by increasing the mass flow of refrigerant to the evaporator which increases cooling capacity, reduces operational time and proportionately reduces electric power usage.

Correcting overcharged systems with improper airflow saves electricity by reducing refrigerant pressure and proportionally reducing electric power usage. It also eliminates problems of liquid refrigerant returning to the compressor causing premature failure. Correcting undercharged air conditioners with improper airflow saves electricity by increasing capacity allowing them to run less which extends the life of the compressor. It also prevents overheating of the compressor and premature failure.

SUMMARY

The present invention addresses the above and other needs by providing expanded target temperature split and target superheat tables based on laboratory data, and mathematical algorithms for distinguishing non-condensables from refrigerant over-charge, and distinguishing refrigerant restrictions from refrigerant under-charge of a cooling system. Methods are disclosed which receive inputs in the form of data describing the cooling system and measurements made from the cooling system, and which estimates the amount of refrigerant to be removed or added to the cooling system for optimal performance. The methods may apply to Fixed Expansion Valve (FXV) systems and may include making and displaying an estimation of a refrigerant adjustment based upon measurements such as return air wetbulb temperature, condenser air entering temperature, refrigerant superheat vapor line temperature, and refrigerant superheat vapor line pressure. The method may apply to Thermostatic Expansion Valve (TXV) systems and may include making and displaying an estimation of a refrigerant adjustment based upon measurements such as refrigerant subcooling liquid line temperature and refrigerant subcooling liquid line pressure. Methods for calculating target temperature split, target superheat, and target enthalpy to ensure correct setup of a cooling system are disclosed. The methods may include distinguishing non-condensables from refrigerant over-charge and distinguishing refrigerant restrictions from under-charge, and making and displaying an estimation of a refrigerant adjustment or of an airflow adjustment based upon measurements such as entering condenser dry bulb temperature, entering return air wet bulb temperature, entering return air dry bulb temperature and supply air dry bulb temperature. Recommendations may also be based upon evaporator coil temperature splits. In addition, methods for ensuring correct setup of a cooling system are disclosed.

In accordance with one aspect of the invention, there is provided a method for verifying proper refrigerant charge and airflow for split-system and packaged air-conditioning systems and heat pump systems in cooling mode to improve performance and efficiency and maintain these attributes over the effective useful life of the air conditioning system.

In accordance with another aspect of the invention, there is provided a method suitable for determining proper R22 and R410a refrigerant level and airflow across the evaporator coil in air-conditioning systems used to cool residential and commercial buildings.

In accordance with still another aspect of the invention, there are provided empirical tables for expanded target temperature split and target superheat and also includes mathematical methods for distinguishing non-condensable air and water vapor faults from refrigerant over-charge and distinguishing refrigerant restrictions from refrigerant under-charge and provides methods to qualitatively and quantitatively improve diagnostic testing and correction of refrigerant charge and airflow for air conditioners and heat pumps in cooling mode. The prior art methods do not provide expanded tables for target temperature split and superheat and do not compute values to distinguish non-condensable air and water vapor faults from refrigerant over-charge and to distinguish refrigerant restrictions from refrigerant under-charge.

In accordance with yet another aspect of the invention, there are provided empirical expanded tables for expanded target temperature split and target superheat and also includes mathematical methods for diagnosing non condensable air and water vapor faults from refrigerant over-charge and refrigerant restrictions from refrigerant under-charge to make a recommendation for recovering refrigerant to address non-condensables or restrictions or to make a refrigerant adjustment or airflow adjustment to improve energy efficiency. The prior art methods do not compute these values nor do they include recommendations based on these calculated values.

In accordance with another aspect of the invention, there is provided a method for calculating target temperature split to ensure correct airflow to achieve optimal energy efficiency performance of a cooling system. The method may apply to a TXV system or an FXV system and may include making and displaying a prediction of target temperature split based upon measurements such as return air wet-bulb temperature and return air dry-bulb temperature.

In accordance with yet another aspect of the invention there is provided a method disclosed for calculating target superheat temperature and tolerances to ensure correct refrigerant charge to achieve optimal energy efficiency of a cooling system. The method may apply to a FXV system and may include making and displaying an estimation of target superheat based upon measurements such as return air wet-bulb temperature and condenser air dry-bulb temperature.

In accordance with another aspect of the invention, there is provided a method for calculating the Condenser Over Ambient (COA) temperature as a function of outdoor air temperature in combination with superheat and subcooling values to detect the presence of non-condensables versus refrigerant overcharge. The method may apply to a TXV or FXV system.

In accordance with still another aspect of the invention, there is provided a method for calculating the evaporator saturation temperature as a function of outdoor air temperature in combination with superheat and subcooling values to detect the presence of refrigerant restrictions versus refrigerant undercharge. The method may apply to a TXV or FXV system.

BRIEF DESCRIPTION OF THE DRAWINGS

The following description is of the best mode presently contemplated for carrying out the invention. This description is not to be taken in a limiting sense, but is made merely for the purpose of describing one or more preferred embodiments of the invention. The scope of the invention should be determined with reference to the claims:

Corresponding reference characters indicate corresponding components throughout the several views of the drawings.

DETAILED DESCRIPTION OF THE PREFERRED EMBODIMENTS

Figure 1:
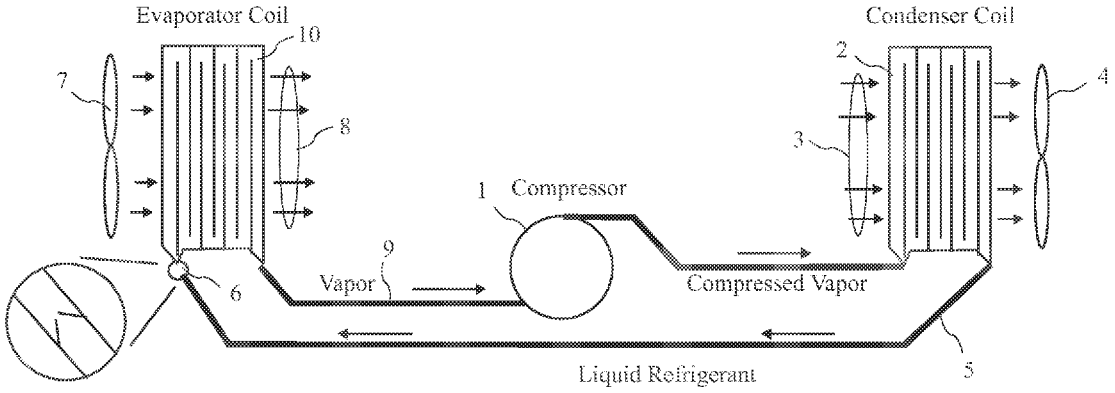
FIG. 1 shows an air conditioning system according to the present invention.

In the following description, for purposes of clarity and conciseness of the description, not all of the numerous engineering equations used to develop the expanded temperature split and superheat tables are described. The engineering equations shown provide a person of ordinary skill in the art a thorough, enabling disclosure of the present invention. The operation of any of the mathematical algorithms would be understood and apparent to one skilled in the art.

Table 3 provides an illustrative example of an expanded empirical target temperature split look up table according to an embodiment of the invention. The target temperature split is defined as the target return air dry-bulb temperature minus the target supply air dry-bulb temperature, for return air dry-bulb temperatures between 62 and 84 degrees Fahrenheit and return air wet-bulb temperatures between 50 and 76 degrees Fahrenheit. The expanded target temperature split values exclude the upper right corner of Table 1 where the target temperature split does not exist since and the return wet-bulb temperature cannot exceed the return dry-bulb temperature and the relative humidity cannot be greater than 100 percent (under atmospheric conditions).

TABLE 3

Expanded Empirical Target Temperature Split

| | | Return Air Wet-Bulb Temperature (° F.) | | | | | | | | | | | | | |
|---|---|---|---|---|---|---|---|---|---|---|---|---|---|---|---|
| | | 50 | 51 | 52 | 53 | 54 | 55 | 56 | 57 | 58 | 59 | 60 | 61 | 62 | 63 |
| Return Air Dry-Bulb Temperature (° F.) | 62 | *19.1* | *18.5* | *17.9* | *17.3* | *16.2* | *15.2* | *14.2* | *13.2* | *12.2* | *11.3* | Undefined Relative Humidity Cannot Exceed 100% | | | |
| | 63 | *19.5* | *18.8* | *18.4* | *17.7* | *16.7* | *16.0* | *15.2* | *14.1* | *13.3* | *12.2* | *11.4* | | | |
| | 64 | *19.7* | *19.1* | *18.7* | *18.1* | *17.3* | *16.7* | *16.0* | *15.0* | *14.2* | *13.2* | *12.4* | *11.5* | | |
| | 65 | *19.9* | *19.4* | *19.0* | *18.5* | *17.9* | *17.4* | *16.8* | *15.9* | *15.1* | *14.2* | *13.4* | *12.6* | *11.6* | |
| | 66 | *20.1* | *19.7* | *19.3* | *18.9* | *18.5* | *18.1* | *17.6* | *16.8* | *16.0* | *15.2* | *14.4* | *13.6* | *12.8* | *11.7* |
| | 67 | *20.3* | *20.1* | *19.7* | *19.2* | *18.9* | *18.7* | *18.0* | *17.3* | *16.6* | *16.1* | *15.3* | *14.5* | *13.8* | *12.6* |
| | 68 | *20.5* | *20.3* | *20.0* | *19.6* | *19.3* | *19.1* | *18.5* | *17.9* | *17.3* | *16.8* | *16.1* | *15.4* | *14.7* | *13.7* |
| | 69 | *20.7* | *20.5* | *20.3* | *20.0* | *19.7* | *19.5* | *19.0* | *18.5* | *18.0* | *17.5* | *16.9* | *16.3* | *15.6* | *14.8* |
| | 70 | 20.9 | 20.7 | 20.6 | 20.4 | 20.1 | 19.9 | 19.5 | 19.1 | 18.7 | 18.2 | 17.7 | 17.2 | 16.5 | 15.9 |
| | 71 | 21.4 | 21.3 | 21.1 | 20.9 | 20.7 | 20.4 | 20.1 | 19.7 | 19.3 | 18.8 | 18.3 | 17.7 | 17.1 | 16.4 |
| | 72 | 21.9 | 21.8 | 21.7 | 21.5 | 21.2 | 20.9 | 20.6 | 20.2 | 19.8 | 19.3 | 18.8 | 18.2 | 17.6 | 17.0 |
| | 73 | 22.5 | 22.4 | 22.2 | 22.0 | 21.8 | 21.5 | 21.2 | 20.8 | 20.3 | 19.9 | 19.4 | 18.8 | 18.2 | 17.5 |

TABLE 3-continued

| Expanded Empirical Target Temperature Split | | | | | | | | | | | | | | |
|---|---|---|---|---|---|---|---|---|---|---|---|---|---|---|
| 74 | 23.0 | 22.9 | 22.8 | 22.6 | 22.3 | 22.0 | 21.7 | 21.3 | 20.9 | 20.4 | 19.9 | 19.3 | 18.7 | 18.1 |
| 75 | 23.6 | 23.5 | 23.3 | 23.1 | 22.9 | 22.6 | 22.2 | 21.9 | 21.4 | 21.0 | 20.4 | 19.9 | 19.3 | 18.6 |
| 76 | 24.1 | 24.0 | 23.9 | 23.7 | 23.4 | 23.1 | 22.8 | 22.4 | 22.0 | 21.5 | 21.0 | 20.4 | 19.8 | 19.2 |
| 77 | *24.7* | 24.6 | 24.4 | 24.2 | 24.0 | 23.7 | 23.3 | 22.9 | 22.5 | 22.0 | 21.5 | 21.0 | 20.4 | 19.7 |
| 78 | *25.3* | *25.2* | *24.9* | 24.7 | 24.5 | 24.2 | 23.9 | 23.5 | 23.1 | 22.6 | 22.1 | 21.5 | 20.9 | 20.2 |
| 79 | *25.9* | *25.8* | *25.5* | *25.3* | *25.1* | 24.8 | 24.4 | 24.0 | 23.6 | 23.1 | 22.6 | 22.1 | 21.4 | 20.8 |
| 80 | *26.5* | *26.4* | *26.1* | *25.9* | *25.7* | *25.4* | 25.0 | 24.6 | 24.2 | 23.7 | 23.2 | 22.6 | 22.0 | 21.3 |
| 81 | *27.1* | *27.0* | *26.7* | *26.5* | *26.3* | *26.0* | *25.6* | 25.1 | 24.7 | 24.2 | 23.7 | 23.1 | 22.5 | 21.9 |
| 82 | *27.7* | *27.6* | *27.3* | *27.1* | *26.9* | *26.6* | *26.2* | *25.7* | 25.2 | 24.8 | 24.2 | 23.7 | 23.1 | 22.4 |
| 83 | *28.2* | *28.1* | *27.8* | *27.6* | *27.4* | *27.1* | *26.7* | *26.2* | *25.7* | 25.3 | 24.8 | 24.2 | 23.6 | 23.0 |
| 84 | *28.7* | *28.6* | *28.3* | *28.1* | *27.9* | *27.6* | *27.2* | *26.7* | *26.2* | 25.9 | 25.3 | 24.8 | 24.2 | 23.5 |
| | 50 | 51 | 52 | 53 | 54 | 55 | 56 | 57 | 58 | 59 | 60 | 61 | 62 | 63 |

| | | Return Air Wet-Bulb Temperature (° F.) | | | | | | | | | | | | | |
|---|---|---|---|---|---|---|---|---|---|---|---|---|---|---|---|
| | | 64 | 65 | 66 | 67 | 68 | 69 | 70 | 71 | 72 | 73 | 74 | 75 | 76 | |
| Return Air Dry-Bulb Temperature (° F.) | 62 | | | | | | | | | | | | | | 62 |
| | 63 | | | | | | | | | | | | | | 63 |
| | 64 | | | | | | | | | | | | | | 64 |
| | 65 | | | | | | | | | | | | | | 65 |
| | 66 | | | | | | | | Undefined Relative | | | | | | 66 |
| | 67 | *11.9* | | | | | | | Humidity Cannot | | | | | | 67 |
| | 68 | *13.0* | *12.2* | | | | | | Exceed 100% | | | | | | 68 |
| | 69 | *14.1* | *13.3* | *12.5* | | | | | | | | | | | 69 |
| | 70 | 15.2 | 14.4 | 13.7 | 12.8 | | | | | | | | | | 70 |
| | 71 | 15.7 | 15.0 | 14.2 | 13.4 | 12.5 | | | | | | | | | 71 |
| | 72 | 16.3 | 15.5 | 14.7 | 13.9 | 13.0 | 12.1 | | | | | | | | 72 |
| | 73 | 16.8 | 16.1 | 15.3 | 14.4 | 13.6 | 12.6 | 11.7 | | | | | | | 73 |
| | 74 | 17.4 | 16.6 | 15.8 | 15.0 | 14.1 | 13.2 | 12.2 | 11.2 | | | | | | 74 |
| | 75 | 17.9 | 17.2 | 16.4 | 15.5 | 14.7 | 13.7 | 12.7 | 11.7 | 10.7 | | | | | 75 |
| | 76 | 18.5 | 17.7 | 16.9 | 16.1 | 15.2 | 14.3 | 13.3 | 12.3 | 11.2 | 10.1 | | | | 76 |
| | 77 | 19.0 | 18.3 | 17.5 | 16.6 | 15.7 | 14.8 | 13.8 | 12.8 | 11.7 | 10.6 | 9.5 | | | 77 |
| | 78 | 19.5 | 18.8 | 18.0 | 17.2 | 16.3 | 15.4 | 14.4 | 13.4 | 12.3 | 11.2 | 10.0 | 8.8 | | 78 |
| | 79 | 20.1 | 19.3 | 18.5 | 17.7 | 16.8 | 15.9 | 14.9 | 13.9 | 12.8 | 11.7 | 10.6 | 9.4 | 8.1 | 79 |
| | 80 | 20.6 | 19.9 | 19.1 | 18.3 | 17.4 | 16.4 | 15.5 | 14.4 | 13.4 | 12.3 | 11.1 | 9.9 | 8.7 | 80 |
| | 81 | 21.2 | 20.4 | 19.6 | 18.8 | 17.9 | 17.0 | 16.0 | 15.0 | 13.9 | 12.8 | 11.7 | 10.4 | 9.2 | 81 |
| | 82 | 21.7 | 21.0 | 20.2 | 19.3 | 18.5 | 17.5 | 16.6 | 15.5 | 14.5 | 13.4 | 12.2 | 11.0 | 9.7 | 82 |
| | 83 | 22.3 | 21.5 | 20.7 | 19.9 | 19.0 | 18.1 | 17.1 | 16.1 | 15.0 | 13.9 | 12.7 | 11.5 | 10.3 | 83 |
| | 84 | 22.8 | 22.1 | 21.3 | 20.4 | 19.5 | 18.6 | 17.6 | 16.6 | 15.6 | 14.4 | 13.3 | 12.1 | 10.8 | 84 |
| | | 64 | 65 | 66 | 67 | 68 | 69 | 70 | 71 | 72 | 73 | 74 | 75 | 76 | |

Table 4 provides an illustrative example of the expanded empirical target superheat look up table according to an embodiment of the invention, defined as the target refrigerant evaporator saturation temperature minus the target refrigerant suction line temperature, for condenser air dry-bulb temperatures between 55 and 115 degrees Fahrenheit (° F.) and return air wet-bulb temperatures between 50 and 76 degrees Fahrenheit. The expanded empirical target temperature split table is based on laboratory measurements of an air conditioning system operated at limiting temperature conditions (e.g., 60 F return dry-bulb, 50 F, 54 F, and 59 F return wet-bulb, 63 F return wet-bulb, and 72 F condenser entering air temperature). The expanded empirical target superheat table is based on laboratory measurements of an air conditioning system operated at limiting temperature conditions (e.g., 80 F return dry-bulb, 57 F return wet-bulb, 63 F return wet-bulb, and 115 F condenser entering air temperature). The 2 F lower limit of target superheat is based on empirical data from laboratory measurements of systems with correct charge and 40% overcharge.

TABLE 4

| Expanded Empirical Target Superheat | | | | | | | | | | | | | | | |
|---|---|---|---|---|---|---|---|---|---|---|---|---|---|---|---|
| | | Entering Air Wet-Bulb Temperature (° F) | | | | | | | | | | | | | |
| | | 50 | 51 | 52 | 53 | 54 | 55 | 56 | 57 | 58 | 59 | 60 | 61 | 62 | 63 |
| Condenser Entering Air Dry-Bulb Temperature (° F.) | 55 | 8.8 | 10.1 | 11.5 | 12.8 | 14.2 | 15.6 | 17.1 | 18.5 | 20.0 | 21.5 | 23.1 | 24.6 | 26.2 | 27.8 |
| | 56 | 8.6 | 9.9 | 11.2 | 12.6 | 14.0 | 15.4 | 16.8 | 18.2 | 19.7 | 21.2 | 22.7 | 24.2 | 25.7 | 27.3 |
| | 57 | 8.3 | 9.6 | 11.0 | 12.3 | 13.7 | 15.1 | 16.5 | 17.9 | 19.4 | 20.8 | 22.3 | 23.8 | 25.3 | 26.8 |
| | 58 | 7.9 | 9.3 | 10.6 | 12.0 | 13.4 | 14.8 | 16.2 | 17.6 | 19.0 | 20.4 | 21.9 | 23.3 | 24.8 | 26.3 |
| | 59 | 7.5 | 8.9 | 10.2 | 11.6 | 13.0 | 14.4 | 15.8 | 17.2 | 18.6 | 20.0 | 21.4 | 22.9 | 24.3 | 25.7 |
| | 60 | 7.0 | 8.4 | 9.8 | 11.2 | 12.6 | 14.0 | 15.4 | 16.8 | 18.2 | 19.6 | 21.0 | 22.4 | 23.8 | 25.2 |
| | 61 | 6.5 | 7.9 | 9.3 | 10.7 | 12.1 | 13.5 | 14.9 | 16.3 | 17.7 | 19.1 | 20.5 | 21.9 | 23.3 | 24.7 |
| | 62 | 6.0 | 7.4 | 8.8 | 10.2 | 11.7 | 13.1 | 14.5 | 15.9 | 17.3 | 18.7 | 20.1 | 21.4 | 22.8 | 24.2 |
| | 63 | 5.3 | 6.8 | 8.3 | 9.7 | 11.1 | 12.6 | 14.0 | 15.4 | 16.8 | 18.2 | 19.6 | 20.9 | 22.3 | 23.6 |
| | 64 | *5.2* | 6.1 | 7.6 | 9.1 | 10.6 | 12.0 | 13.5 | 14.9 | 16.3 | 17.7 | 19.0 | 20.4 | 21.7 | 23.1 |

TABLE 4-continued

Expanded Empirical Target Superheat

| | | | | | | | | | | | | | | |
|---|---|---|---|---|---|---|---|---|---|---|---|---|---|---|
| 65 | 5.1 | 5.4 | 7.0 | 8.5 | 10.0 | 11.5 | 12.9 | 14.3 | 15.8 | 17.1 | 18.5 | 19.9 | 21.2 | 22.5 |
| 66 | 5.0 | 5.3 | 6.3 | 7.8 | 9.3 | 10.8 | 12.3 | 13.8 | 15.2 | 16.6 | 18.0 | 19.3 | 20.7 | 22.0 |
| 67 | 4.9 | 5.2 | 5.5 | 7.1 | 8.7 | 10.2 | 11.7 | 13.2 | 14.6 | 16.0 | 17.4 | 18.8 | 20.1 | 21.4 |
| 68 | 4.8 | 5.1 | 5.4 | 6.3 | 8.0 | 9.5 | 11.1 | 12.6 | 14.0 | 15.5 | 16.8 | 18.2 | 19.5 | 20.8 |
| 69 | 4.7 | 4.9 | 5.3 | 5.5 | 7.2 | 8.8 | 10.4 | 11.9 | 13.4 | 14.8 | 16.3 | 17.6 | 19.0 | 20.3 |
| 70 | 4.6 | 4.8 | 5.1 | 5.4 | 6.4 | 8.1 | 9.7 | 11.2 | 12.7 | 14.2 | 15.7 | 17.0 | 18.4 | 19.7 |
| 71 | 4.5 | 4.7 | 5.0 | 5.2 | 5.6 | 7.3 | 8.9 | 10.5 | 12.1 | 13.6 | 15.0 | 16.4 | 17.8 | 19.1 |
| 72 | 4.4 | 4.6 | 4.9 | 5.1 | 5.5 | 6.4 | 8.1 | 9.8 | 11.4 | 12.9 | 14.4 | 15.8 | 17.2 | 18.5 |
| 73 | 4.3 | 4.5 | 4.8 | 5.0 | 5.3 | 5.6 | 7.3 | 9.0 | 10.7 | 12.2 | 13.7 | 15.2 | 16.6 | 17.9 |
| 74 | 4.2 | 4.4 | 4.6 | 4.8 | 5.2 | 5.4 | 6.5 | 8.2 | 9.9 | 11.5 | 13.1 | 14.5 | 15.9 | 17.3 |
| 75 | 4.1 | 4.3 | 4.5 | 4.7 | 5.0 | 5.3 | 5.6 | 7.4 | 9.2 | 10.8 | 12.4 | 13.9 | 15.3 | 16.7 |
| 76 | 4.0 | 4.2 | 4.4 | 4.6 | 4.9 | 5.1 | 5.4 | 6.6 | 8.4 | 10.1 | 11.7 | 13.2 | 14.7 | 16.1 |
| 77 | 3.9 | 4.0 | 4.3 | 4.4 | 4.7 | 5.0 | 5.3 | 5.7 | 7.5 | 9.3 | 11.0 | 12.5 | 14.0 | 15.4 |
| 78 | 3.8 | 3.9 | 4.1 | 4.3 | 4.6 | 4.8 | 5.1 | 5.5 | 6.7 | 8.5 | 10.2 | 11.8 | 13.4 | 14.8 |
| 79 | 3.7 | 3.8 | 4.0 | 4.2 | 4.4 | 4.6 | 4.9 | 5.3 | 5.9 | 7.7 | 9.5 | 11.1 | 12.7 | 14.2 |
| 80 | 3.5 | 3.7 | 3.9 | 4.0 | 4.3 | 4.5 | 4.8 | 5.1 | 5.7 | 6.9 | 8.7 | 10.4 | 12.0 | 13.5 |
| 81 | 3.4 | 3.6 | 3.8 | 3.9 | 4.1 | 4.3 | 4.6 | 4.9 | 5.5 | 6.0 | 7.9 | 9.7 | 11.3 | 12.9 |
| 82 | 3.3 | 3.5 | 3.6 | 3.8 | 4.0 | 4.2 | 4.4 | 4.8 | 5.3 | 5.2 | 7.1 | 8.9 | 10.6 | 12.2 |
| 83 | 3.2 | 3.4 | 3.5 | 3.6 | 3.8 | 4.0 | 4.2 | 4.6 | 5.1 | 5.0 | 6.3 | 8.2 | 9.9 | 11.6 |
| 84 | 3.1 | 3.2 | 3.4 | 3.5 | 3.7 | 3.9 | 4.1 | 4.4 | 4.9 | 4.9 | 5.5 | 7.4 | 9.2 | 10.9 |
| 85 | 3.0 | 3.1 | 3.3 | 3.3 | 3.5 | 3.7 | 3.9 | 4.2 | 4.7 | 4.7 | 5.3 | 6.6 | 8.5 | 10.3 |
| 86 | 2.9 | 3.0 | 3.1 | 3.2 | 3.4 | 3.5 | 3.7 | 4.0 | 4.5 | 4.5 | 5.1 | 5.8 | 7.8 | 9.6 |
| 87 | 2.8 | 2.9 | 3.0 | 3.1 | 3.2 | 3.4 | 3.6 | 3.8 | 4.3 | 4.3 | 4.9 | 5.0 | 7.0 | 8.9 |
| 88 | 2.7 | 2.8 | 2.9 | 2.9 | 3.1 | 3.2 | 3.4 | 3.6 | 4.1 | 4.2 | 4.7 | 4.8 | 6.3 | 8.2 |
| 89 | 2.6 | 2.7 | 2.8 | 2.8 | 2.9 | 3.1 | 3.2 | 3.4 | 3.9 | 4.0 | 4.5 | 4.6 | 5.5 | 7.5 |
| 90 | 2.5 | 2.6 | 2.6 | 2.7 | 2.8 | 2.9 | 3.1 | 3.2 | 3.7 | 3.8 | 4.3 | 4.4 | 5.3 | 6.8 |
| 91 | 2.0 | 2.5 | 2.5 | 2.5 | 2.6 | 2.7 | 2.9 | 3.1 | 3.5 | 3.7 | 4.1 | 4.2 | 5.0 | 6.1 |
| 92 | 2.0 | 2.0 | 2.4 | 2.4 | 2.5 | 2.6 | 2.7 | 2.9 | 3.3 | 3.5 | 3.9 | 4.0 | 4.8 | 5.4 |
| 93 | 2.0 | 2.0 | 2.0 | 2.3 | 2.3 | 2.4 | 2.5 | 2.7 | 3.1 | 3.3 | 3.7 | 3.8 | 4.6 | 5.1 |
| 94 | 2.0 | 2.0 | 2.0 | 2.0 | 2.0 | 2.3 | 2.4 | 2.5 | 2.9 | 3.2 | 3.5 | 3.7 | 4.4 | 4.8 |
| 95 | 2.0 | 2.0 | 2.0 | 2.0 | 2.0 | 2.1 | 2.2 | 2.3 | 2.7 | 3.0 | 3.3 | 3.5 | 4.1 | 4.5 |
| 96 | 2.0 | 2.0 | 2.0 | 2.0 | 2.0 | 2.1 | 2.2 | 2.3 | 2.5 | 2.8 | 3.1 | 3.3 | 3.9 | 4.3 |
| 97 | 2.0 | 2.0 | 2.0 | 2.0 | 2.0 | 2.1 | 2.2 | 2.3 | 2.3 | 2.6 | 2.9 | 3.1 | 3.7 | 4.0 |
| 98 | 2.0 | 2.0 | 2.0 | 2.0 | 2.0 | 2.1 | 2.2 | 2.3 | 2.3 | 2.5 | 2.7 | 2.9 | 3.5 | 3.7 |
| 99 | 2.0 | 2.0 | 2.0 | 2.0 | 2.0 | 2.1 | 2.2 | 2.3 | 2.3 | 2.3 | 2.5 | 2.7 | 3.2 | 3.4 |
| 100 | 2.0 | 2.0 | 2.0 | 2.0 | 2.0 | 2.1 | 2.2 | 2.3 | 2.3 | 2.3 | 2.3 | 2.5 | 3.0 | 3.1 |
| 101 | 2.0 | 2.0 | 2.0 | 2.0 | 2.0 | 2.1 | 2.2 | 2.3 | 2.3 | 2.3 | 2.3 | 2.3 | 2.8 | 2.8 |
| 102 | 2.0 | 2.0 | 2.0 | 2.0 | 2.0 | 2.1 | 2.2 | 2.3 | 2.3 | 2.3 | 2.3 | 2.3 | 2.6 | 3.4 |
| 103 | 2.0 | 2.0 | 2.0 | 2.0 | 2.0 | 2.1 | 2.2 | 2.3 | 2.3 | 2.3 | 2.3 | 2.3 | 2.4 | 3.1 |
| 104 | 2.0 | 2.0 | 2.0 | 2.0 | 2.0 | 2.1 | 2.2 | 2.3 | 2.3 | 2.3 | 2.3 | 2.3 | 2.4 | 2.9 |
| 105 | 2.0 | 2.0 | 2.0 | 2.0 | 2.0 | 2.1 | 2.2 | 2.3 | 2.3 | 2.3 | 2.3 | 2.3 | 2.3 | 2.7 |
| 106 | 2.0 | 2.0 | 2.0 | 2.0 | 2.0 | 2.1 | 2.2 | 2.3 | 2.3 | 2.3 | 2.3 | 2.3 | 2.3 | 2.5 |
| 107 | 2.0 | 2.0 | 2.0 | 2.0 | 2.0 | 2.1 | 2.2 | 2.3 | 2.3 | 2.3 | 2.3 | 2.3 | 2.3 | 2.4 |
| 108 | 2.0 | 2.0 | 2.0 | 2.0 | 2.0 | 2.1 | 2.2 | 2.3 | 2.3 | 2.3 | 2.3 | 2.3 | 2.3 | 2.4 |
| 109 | 2.0 | 2.0 | 2.0 | 2.0 | 2.0 | 2.1 | 2.2 | 2.3 | 2.3 | 2.3 | 2.3 | 2.3 | 2.3 | 2.3 |
| 110 | 2.0 | 2.0 | 2.0 | 2.0 | 2.0 | 2.1 | 2.2 | 2.3 | 2.3 | 2.3 | 2.3 | 2.3 | 2.3 | 2.3 |
| 111 | 2.0 | 2.0 | 2.0 | 2.0 | 2.0 | 2.1 | 2.2 | 2.3 | 2.3 | 2.3 | 2.3 | 2.3 | 2.3 | 2.3 |
| 112 | 2.0 | 2.0 | 2.0 | 2.0 | 2.0 | 2.1 | 2.2 | 2.3 | 2.3 | 2.3 | 2.3 | 2.3 | 2.3 | 2.3 |
| 113 | 2.0 | 2.0 | 2.0 | 2.0 | 2.0 | 2.1 | 2.2 | 2.3 | 2.3 | 2.3 | 2.3 | 2.3 | 2.3 | 2.3 |
| 114 | 2.0 | 2.0 | 2.0 | 2.0 | 2.0 | 2.1 | 2.2 | 2.3 | 2.3 | 2.3 | 2.3 | 2.3 | 2.3 | 2.3 |
| 115 | 2.0 | 2.0 | 2.0 | 2.0 | 2.0 | 2.1 | 2.2 | 2.3 | 2.3 | 2.3 | 2.3 | 2.3 | 2.3 | 2.3 |

| | 50 | 51 | 52 | 53 | 54 | 55 | 56 | 57 | 58 | 59 | 60 | 61 | 62 | 63 |
|---|---|---|---|---|---|---|---|---|---|---|---|---|---|---|

Entering Air Wet-Bulb Temperature (° F)

| | | 64 | 65 | 66 | 67 | 68 | 69 | 70 | 71 | 72 | 73 | 74 | 75 | 76 | |
|---|---|---|---|---|---|---|---|---|---|---|---|---|---|---|---|
| Condenser | 55 | 29.4 | 31.0 | 32.4 | 33.8 | 35.1 | 36.4 | 37.7 | 39.0 | 40.2 | 41.5 | 42.7 | 43.9 | 45.0 | 55 |
| Entering | 56 | 28.9 | 30.5 | 31.8 | 33.2 | 34.6 | 35.9 | 37.2 | 38.5 | 39.7 | 41.0 | 42.2 | 43.4 | 44.6 | 56 |
| Air Dry-Bulb | 57 | 28.3 | 29.9 | 31.3 | 32.6 | 34.0 | 35.3 | 36.7 | 38.0 | 39.2 | 40.5 | 41.7 | 43.0 | 44.2 | 57 |
| Temperature | 58 | 27.8 | 29.3 | 30.7 | 32.1 | 33.5 | 34.8 | 36.1 | 37.5 | 38.7 | 40.0 | 41.3 | 42.5 | 43.7 | 58 |
| (° F.) | 59 | 27.2 | 28.7 | 30.1 | 31.5 | 32.9 | 34.3 | 35.6 | 36.9 | 38.3 | 39.5 | 40.8 | 42.1 | 43.3 | 59 |
| | 60 | 26.6 | 28.1 | 29.6 | 31.0 | 32.4 | 33.7 | 35.1 | 36.4 | 37.8 | 39.1 | 40.4 | 41.6 | 42.9 | 60 |
| | 61 | 26.1 | 27.5 | 29.0 | 30.4 | 31.8 | 33.2 | 34.6 | 35.9 | 37.3 | 38.6 | 39.9 | 41.2 | 42.4 | 61 |
| | 62 | 25.5 | 27.0 | 28.4 | 29.9 | 31.3 | 32.7 | 34.1 | 35.4 | 36.8 | 38.1 | 39.4 | 40.7 | 42.0 | 62 |
| | 63 | 25.0 | 26.4 | 27.8 | 29.3 | 30.7 | 32.2 | 33.6 | 34.9 | 36.3 | 37.7 | 39.0 | 40.3 | 41.6 | 63 |
| | 64 | 24.4 | 25.8 | 27.3 | 28.7 | 30.2 | 31.6 | 33.0 | 34.4 | 35.8 | 37.2 | 38.5 | 39.9 | 41.2 | 64 |
| | 65 | 23.8 | 25.2 | 26.7 | 28.2 | 29.7 | 31.1 | 32.5 | 33.9 | 35.3 | 36.7 | 38.1 | 39.4 | 40.8 | 65 |
| | 66 | 23.2 | 24.6 | 26.1 | 27.6 | 29.1 | 30.6 | 32.0 | 33.4 | 34.9 | 36.3 | 37.6 | 39.0 | 40.4 | 66 |
| | 67 | 22.7 | 24.1 | 25.6 | 27.1 | 28.6 | 30.1 | 31.5 | 33.0 | 34.4 | 35.8 | 37.2 | 38.6 | 39.9 | 67 |

TABLE 4-continued

| Expanded Empirical Target Superheat | | | | | | | | | | | | | | |
|---|---|---|---|---|---|---|---|---|---|---|---|---|---|---|
| 68 | 22.1 | 23.5 | 25.0 | 26.5 | 28.0 | 29.5 | 31.0 | 32.5 | 33.9 | 35.3 | 36.8 | 38.1 | 39.5 | 68 |
| 69 | 21.5 | 22.9 | 24.4 | 26.0 | 27.5 | 29.0 | 30.5 | 32.0 | 33.4 | 34.9 | 36.3 | 37.7 | 39.1 | 69 |
| 70 | 20.9 | 22.3 | 23.9 | 25.4 | 27.0 | 28.5 | 30.0 | 31.5 | 33.0 | 34.4 | 35.9 | 37.3 | 38.7 | 70 |
| 71 | 20.3 | 21.7 | 23.3 | 24.9 | 26.4 | 28.0 | 29.5 | 31.0 | 32.5 | 34.0 | 35.4 | 36.9 | 38.3 | 71 |
| 72 | 19.7 | 21.2 | 22.8 | 24.3 | 25.9 | 27.4 | 29.0 | 30.5 | 32.0 | 33.5 | 35.0 | 36.5 | 37.9 | 72 |
| 73 | 19.2 | 20.6 | 22.2 | 23.8 | 25.4 | 26.9 | 28.5 | 30.0 | 31.5 | 33.1 | 34.6 | 36.0 | 37.5 | 73 |
| 74 | 18.6 | 20.0 | 21.6 | 23.2 | 24.8 | 26.4 | 28.0 | 29.5 | 31.1 | 32.6 | 34.1 | 35.6 | 37.1 | 74 |
| 75 | 18.0 | 19.4 | 21.1 | 22.7 | 24.3 | 25.9 | 27.5 | 29.1 | 30.6 | 32.2 | 33.7 | 35.2 | 36.7 | 75 |
| 76 | 17.4 | 18.9 | 20.5 | 22.1 | 23.8 | 25.4 | 27.0 | 28.6 | 30.1 | 31.7 | 33.3 | 34.8 | 36.3 | 76 |
| 77 | 16.8 | 18.3 | 20.0 | 21.6 | 23.2 | 24.9 | 26.5 | 28.1 | 29.7 | 31.3 | 32.8 | 34.4 | 36.0 | 77 |
| 78 | 16.2 | 17.7 | 19.4 | 21.1 | 22.7 | 24.4 | 26.0 | 27.6 | 29.2 | 30.8 | 32.4 | 34.0 | 35.6 | 78 |
| 79 | 15.6 | 17.1 | 18.8 | 20.5 | 22.2 | 23.8 | 25.5 | 27.1 | 28.8 | 30.4 | 32.0 | 33.6 | 35.2 | 79 |
| 80 | 15.0 | 16.6 | 18.3 | 20.0 | 21.7 | 23.3 | 25.0 | 26.7 | 28.3 | 29.9 | 31.6 | 33.2 | 34.8 | 80 |
| 81 | 14.3 | 16.0 | 17.7 | 19.4 | 21.1 | 22.8 | 24.5 | 26.2 | 27.9 | 29.5 | 31.2 | 32.8 | 34.4 | 81 |
| 82 | 13.7 | 15.4 | 17.2 | 18.9 | 20.6 | 22.3 | 24.0 | 25.7 | 27.4 | 29.1 | 30.7 | 32.4 | 34.0 | 82 |
| 83 | 13.1 | 14.9 | 16.6 | 18.4 | 20.1 | 21.8 | 23.5 | 25.2 | 26.9 | 28.6 | 30.3 | 32.0 | 33.7 | 83 |
| 84 | 12.5 | 14.3 | 16.1 | 17.8 | 19.6 | 21.3 | 23.0 | 24.8 | 26.5 | 28.2 | 29.9 | 31.6 | 33.3 | 84 |
| 85 | 11.9 | 13.7 | 15.5 | 17.3 | 19.0 | 20.8 | 22.6 | 24.3 | 26.0 | 27.8 | 29.5 | 31.2 | 32.9 | 85 |
| 86 | 11.3 | 13.2 | 15.0 | 16.7 | 18.5 | 20.3 | 22.1 | 23.8 | 25.6 | 27.3 | 29.1 | 30.8 | 32.6 | 86 |
| 87 | 10.6 | 12.6 | 14.4 | 16.2 | 18.0 | 19.8 | 21.6 | 23.4 | 25.1 | 26.9 | 28.7 | 30.4 | 32.2 | 87 |
| 88 | 10.0 | 12.0 | 13.9 | 15.7 | 17.5 | 19.3 | 21.1 | 22.9 | 24.7 | 26.5 | 28.3 | 30.1 | 31.8 | 88 |
| 89 | 9.4 | 11.5 | 13.3 | 15.1 | 17.0 | 18.8 | 20.6 | 22.4 | 24.3 | 26.1 | 27.9 | 29.7 | 31.5 | 89 |
| 90 | 8.8 | 10.9 | 12.8 | 14.6 | 16.5 | 18.3 | 20.1 | 22.0 | 23.8 | 25.6 | 27.5 | 29.3 | 31.1 | 90 |
| 91 | 8.1 | 10.3 | 12.2 | 14.1 | 15.9 | 17.8 | 19.7 | 21.5 | 23.2 | 25.2 | 27.1 | 28.9 | 30.8 | 91 |
| 92 | 7.5 | 9.8 | 11.7 | 13.5 | 15.4 | 17.3 | 19.2 | 21.1 | 22.9 | 24.8 | 26.7 | 28.5 | 30.4 | 92 |
| 93 | 6.8 | 9.2 | 11.1 | 13.0 | 14.9 | 16.8 | 18.7 | 20.6 | 22.5 | 24.4 | 26.3 | 28.2 | 30.1 | 93 |
| 94 | 6.2 | 8.7 | 10.6 | 12.5 | 14.4 | 16.3 | 18.2 | 20.2 | 22.1 | 24.0 | 25.9 | 27.8 | 29.7 | 94 |
| 95 | 5.6 | 8.1 | 10.0 | 12.0 | 13.9 | 15.8 | 17.8 | 19.7 | 21.6 | 23.6 | 25.5 | 27.4 | 29.4 | 95 |
| 96 | 5.3 | 7.5 | 9.5 | 11.4 | 13.4 | 15.3 | 17.3 | 19.2 | 21.2 | 23.2 | 25.1 | 27.1 | 29.0 | 96 |
| 97 | 5.0 | 7.0 | 8.9 | 10.9 | 12.9 | 14.9 | 16.8 | 18.8 | 20.8 | 22.7 | 24.7 | 26.7 | 28.7 | 97 |
| 98 | 4.8 | 6.4 | 8.4 | 10.4 | 12.4 | 14.4 | 16.4 | 18.3 | 20.3 | 22.3 | 24.3 | 26.3 | 28.3 | 98 |
| 99 | 4.5 | 5.8 | 7.9 | 9.9 | 11.9 | 13.9 | 15.9 | 17.9 | 19.9 | 21.9 | 24.0 | 26.0 | 28.0 | 99 |
| 100 | 4.2 | 5.3 | 7.3 | 9.3 | 11.4 | 13.4 | 15.4 | 17.5 | 19.5 | 21.5 | 23.6 | 25.6 | 27.7 | 100 |
| 101 | 3.9 | 4.9 | 6.8 | 8.8 | 10.9 | 12.9 | 15.0 | 17.0 | 19.1 | 21.1 | 23.2 | 25.3 | 27.3 | 101 |
| 102 | 4.1 | 4.7 | 6.2 | 8.3 | 10.4 | 12.4 | 14.5 | 16.6 | 18.6 | 20.7 | 22.8 | 24.9 | 27.0 | 102 |
| 103 | 3.8 | 4.5 | 5.7 | 7.8 | 9.9 | 11.9 | 14.0 | 16.1 | 18.2 | 20.3 | 22.4 | 24.5 | 26.7 | 103 |
| 104 | 3.6 | 4.2 | 5.2 | 7.2 | 9.3 | 11.5 | 13.6 | 15.7 | 17.8 | 19.9 | 22.1 | 24.2 | 26.3 | 104 |
| 105 | 3.4 | 4.0 | 4.9 | 6.7 | 8.8 | 11.0 | 13.1 | 15.2 | 17.4 | 19.5 | 21.7 | 23.8 | 26.0 | 105 |
| 106 | 3.2 | 3.9 | 4.7 | 6.2 | 8.3 | 10.5 | 12.6 | 14.8 | 17.0 | 19.1 | 21.3 | 23.5 | 25.7 | 106 |
| 107 | 3.1 | 3.8 | 4.6 | 5.7 | 7.9 | 10.0 | 12.2 | 14.4 | 16.6 | 18.7 | 21.0 | 23.2 | 25.4 | 107 |
| 108 | 3.1 | 3.7 | 4.4 | 5.2 | 7.4 | 9.5 | 11.7 | 13.9 | 16.1 | 18.4 | 20.6 | 22.8 | 25.1 | 108 |
| 109 | 2.9 | 3.5 | 4.2 | 5.0 | 6.9 | 9.1 | 11.3 | 13.5 | 15.7 | 18.0 | 20.2 | 22.5 | 24.7 | 109 |
| 110 | 2.8 | 3.4 | 4.1 | 4.8 | 6.4 | 8.6 | 10.8 | 13.1 | 15.3 | 17.6 | 19.9 | 22.1 | 24.4 | 110 |
| 111 | 2.8 | 3.3 | 3.9 | 4.6 | 5.9 | 8.1 | 10.4 | 12.6 | 14.9 | 17.2 | 19.5 | 21.8 | 24.1 | 111 |
| 112 | 2.7 | 3.2 | 3.8 | 4.4 | 5.4 | 7.6 | 9.9 | 12.2 | 14.5 | 16.8 | 19.1 | 21.5 | 23.8 | 112 |
| 113 | 2.7 | 3.1 | 3.6 | 4.2 | 5.0 | 7.2 | 9.5 | 11.8 | 14.1 | 16.4 | 18.8 | 21.1 | 23.5 | 113 |
| 114 | 2.6 | 2.9 | 3.4 | 4.0 | 4.6 | 6.7 | 9.0 | 11.4 | 13.7 | 16.1 | 18.4 | 20.8 | 23.2 | 114 |
| 115 | 2.6 | 3.0 | 3.4 | 3.8 | 4.2 | 6.2 | 8.6 | 10.9 | 13.3 | 15.7 | 18.1 | 20.5 | 22.9 | 115 |
| | 64 | 65 | 66 | 67 | 68 | 69 | 70 | 71 | 72 | 73 | 74 | 75 | 76 | |

Laboratory tests of non-condensables for a split system air conditioner were set-up to approximate conditions that would occur if a vacuum were performed correctly on the system during installation. The line set and evaporator cooling coil were flushed with nitrogen at 300 psig and then allowed to equalize to atmospheric pressure. The unit was then sealed and charged to known optimum charge. The estimated amount of nitrogen remaining in the system was 0.3 ounces. The ARI 700 Specification for Fluorocarbon Refrigerant states that maximum allowable levels of contaminants for R22 and R410A are 10 parts per million (ppm) by weight for water, and 1.5% by volume at 75° F. (29.3 C) for air and other non-condensables. This is 200 times less than 0.3 ounces.[1]

[1] ARI Standard 700-2006 Specifications for Fluorocarbon Refrigerants.

Data were taken on the system at the nominal "A" test conditions (95° F. ambient dry bulb and 80° F. dry bulb/67° F. wet-bulb return air). The non-condensables caused the superheat leaving the expansion device to mimic an over-charged diagnosis. Charge was removed until the unit reached proper superheat leaving the evaporator and the "A" test was repeated. Impacts on compressor power were significant for both tests.

Extended tests (A through D standards, plus additional steady state data over a range of ambient conditions) were performed for similar amounts of nitrogen in the system. For these tests, 0.3 oz of nitrogen was added to the system instead of relying on estimates based on the volume of nitrogen filled components. These extended tests were performed with the system using both the Thermostatic Expansion Valve (TXV) and the non-TXV devices.

Table 5 provides laboratory test results for 0.3 oz (~0.3% of system charge) of non-condensable nitrogen on the unit operating with the TXV. The loss of efficiency is −12.2% for the Energy Efficiency Ratio (EER)*$_A$, −13.4% for EER*$_B$, and −13.4% for Service Energy Efficiency Rating (SEER)*. The non-condensables increased unit power consumption at the "A" test condition by 201 Watts or 6.1%.

TABLE 5

| Laboratory Tests for Non-condensables on TXV Unit | | | | | | | | |
|---|---|---|---|---|---|---|---|---|
| Description | $EER^*_A$ Capacity (kBtuh) | $EER^*_A$ | $EER^*_A$ Impact % | $EER^*_B$ | $EER^*_B$ Impact % | SEER* | SEER* Impact % | Test ID |
| Baseline | 31,054 | 9.48 | NA | 11.14 | NA | 9.21 | NA | 303 |
| 0.3% non-condensable | 27,373 | 8.27 | −12.2% | 9.65 | −13.4% | 7.98 | −13.4% | 505 |

Table 6 provides laboratory test results for 0.3 oz (~0.28% of system charge) of non-condensable nitrogen on the non-TXV unit. The loss of efficiency is −18.2% for the $EER^*_A$, −22.5% for the $EER^*_B$, and −18.5% for SEER*. The presence of non-condensables increased electric power consumption by 252 W or 7.6% for the $EER^*_A$ test.

The first trial set of non-condensable were also tested with a charge adjustment to provide correct superheat leaving the evaporator. The efficiency improved by 2% at the "A" test point. The efficiency increase was a result of reduced unit power consumption as cooling capacity was unchanged. The impact of ~1% non-condensables (Test 501X) was −37.7% for the $EER^*_A$ test with a power consumption increase of 0.71 kW (22%). Earlier tests with high levels of nitrogen where charge was adjusted to provide correct superheat leaving the evaporator indicates that unit efficiency would improve with the removal of charge. With correct superheat, cooling capacity increased to near its rated value and unit power consumption showed a modest reduction. For the one set of tests where direct comparison could be made, the overall $EER^*_A$ efficiency improvement is 2% from the charge adjustment.

Test 501X data is for a unit with full refrigerant recovery (i.e., condenser, compressor, and evaporator), and time-based evacuation with vacuum pump containing dirty oil. The time-based evacuation was approximately 8 hours rather than evacuating to 500 microns and checking that vacuum held at 500 to 700 microns for 10 minutes. Similar vacuum procedures (time only without the use of a pressure gauge) are common in field installations. It is likely that all but the newest service vacuum pumps would have contaminated oil. Based on this observation, the presence of some level of non-condensables in newly installed systems should be considered common.

TABLE 6

| Laboratory Tests for Non-condensables on non-TXV Unit | | | | | | | | |
|---|---|---|---|---|---|---|---|---|
| Description | $EER^*_A$ Capacity (kBtuh) | $EER^*_A$ | $EER^*_A$ Impact % | $EER^*_B$ | $EER^*_B$ Impact % | SEER* | SEER* Impact % | Test ID |
| Baseline | 31,050 | 9.42 | NA | 10.64 | NA | 8.86 | NA | 189-4 |
| 0.3% non-condensable | 27,373 | 7.71 | −18.2% | 8.25 | −22.5% | 7.22 | −18.5% | 501 |
| ~1% non-condensable (improper evacuation) | 20,486 | 5.87 | −37.7% | | | | | 501X |

Refrigerant restrictions can be caused by partial orifice freeze-up from moisture (non-condensables), TXV adjusted too far closed, expansion valve defect, metering device restrictions (non-TXV or TXV), plugged inlet screen, foreign material in the orifice, filter drier restrictions, kinked or restricted liquid or suction lines, oil logged refrigerant flooding the compressor, wax buildup in valve from wrong oil in system, flux, or sludge from byproducts of compressor burnout. If the restriction is at the metering device, then frost or ice will develop at this location. If the restriction is at the liquid line or filter drier, then the liquid line temperature will be colder than ambient with an inlet minus outlet temperature difference of approximately 5° F. or greater.

Correcting restrictions requires recovery of refrigerant, removal of restriction, installation of filter drier, nitrogen purge and leak test, and proper system evacuation. A new filter drier must be installed on all new systems and anytime the system is opened. Filter driers remove moisture, acid, contaminants (scale, solder particles, dirt), hydrochloric, hydrofluoric, and various organic acids, varnish, and sludge. If pressure slowly rises to 1500 microns, the system has air or moisture. If pressure rapidly rises to atmospheric pressure system has leaks. If the vacuum holds at or slightly above 500 microns after 5 to 20 minutes, then the vacuum is complete, and the system can be recharged with clean refrigerant. Restrictions can be avoided with proper installation, evacuation, and maintenance, procedures.

At present there is no database on the relative severity of refrigerant restrictions. Restrictions were generated in the laboratory by adding a valve in the liquid line before the expansion valve. The valve position was adjusted until the evaporator saturation temperature was reduced by 14° F. to 18° F. and the overall system pressure ratio (ratio of pressure readings across the service ports) increased by 15% to 20%. These changes in system operating conditions are equivalent to a system under-charge of between 10 and 15% of full charge. As such, these tests would not be sufficiently severe as to generate cooling coil icing at ambient temperatures that would require significant cooling system operation. The impact of the restriction used in the laboratory tests would likely go undetected by a system's owner or typical service technician.

Table 7 provides laboratory test results for refrigerant restrictions on the non-TXV unit. The efficiency impact is −29.7% for the $EER^*_A$ test, −45.4% for the $EER^*_B$ test, and −35.4% for the SEER* test. Unit power decreased by 100 Watts, or 3%. Trends of changes in unit performance mirror those for under-charged units. That is, efficiency decreases even though power consumption decreases since the fall off in capacity is more rapid than the decrease in unit power consumption.

TABLE 7

Laboratory Tests for Refrigerant Restrictions on non-TXV Unit

| Description | $EER^*_A$ Capacity (kBtuh) | $EER^*_A$ | $EER^*_A$ Impact % | $EER^*_B$ | $EER^*_B$ Impact % | SEER* | SEER* Impact % | Test ID |
|---|---|---|---|---|---|---|---|---|
| Base no restriction non-TXV | 32,759 | 9.42 | NA | 10.64 | NA | 8.86 | NA | 189 |
| Refrig. restriction non-TXV | 22,385 | 6.62 | −29.7% | 5.81 | −45.4% | 5.72 | −35.4% | 701 |

Table 8 provides laboratory tests for refrigerant restrictions on the TXV unit. The impact is −36.1% for the $EER^*_A$ test, −54.9% for the $EER^*_B$ test, and −59% for the SEER* test.

TABLE 8

Laboratory Tests for Refrigerant Restrictions on TXV Unit

| Description | $EER^*_A$ Capacity (kBtuh) | $EER^*_A$ | $EER^*_A$ Impact % | $EER^*_B$ | $EER^*_B$ Impact % | SEER* | SEER* Impact % | Test ID |
|---|---|---|---|---|---|---|---|---|
| Base no restriction TXV | 32,764 | 9.48 | NA | 11.14 | NA | 9.21 | NA | 303 |
| Refrig. restriction TXV | 19,812 | 6.06 | −36.1% | 5.02 | −54.9% | 3.78 | −59% | 801 |

FIG. 1 is a schematic diagram showing an exemplary R22 or R410a air-conditioning system with provision for refrigerant charge and airflow measurements according to an embodiment of the present invention. Typically, the compressor 1 compresses refrigerant into high-pressure vapor. Refrigerant vapor thus enters condenser coil 2. Outdoor fan 4 draws air 3 through the condenser coil 2 cooling the refrigerant by removing heat and condensing the refrigerant to a liquid. Liquid refrigerant 5 moves along a refrigerant pipeline to an evaporator coil through an FXV metering device (or alternatively, through a TXV metering device) 6.

The metering device 6 may control the rate at which the refrigerant enters the evaporator coil 10 and may also create a pressure drop. This allows the refrigerant to expand from a small diameter tube to a larger one. Fan 7 blows an air flow 8 through the evaporator coil and the refrigerant absorbs heat from the air flow 8 cooling the air flow 8 and the refrigerant evaporates back to vapor 9. The refrigerant vapor 9 returns to the compressor 1 to start cycle over again.

Cooling system measurements may be used to lookup the target superheat using the expanded superheat table, and diagnose proper refrigerant charge and recommend a weight of refrigerant to add or remove from the air conditioning system, to achieve a balance of saturated refrigerant vapor in the evaporator coil and condenser coil to provide optimal cooling capacity and/or energy efficiency. Examples of suitable processors for evaluating the measurements include: a Personal Digital Assistant Expert-system Software (PDAES) or Telephony Expert-system Software (TES), deploying Interactive Voice Response (IVR) technologies; 3) personal computer (PC) software; and 4) internet database software, accessed via a web-based browser interface.

For air conditioners equipped with FXV devices 6, a factory refrigerant charge, and the following measurements may be evaluated: Return wet-bulb and return air dry-bulb temperature measured at the evaporator coil (near 7, FIG. 1); Supply dry-bulb temperature measured at the outlet of the evaporator coil (near 8, FIG. 1); Condenser air entering temperature measured at the condenser coil (near 3, FIG. 1); Vapor temperature and Vapor pressure, both measured at compressor return (near 9, FIG. 1), Liquid temperature and Liquid pressure, both measured at condenser coil exit (near 5, FIG. 1).

For air conditioners equipped with TXV devices, the factory refrigerant charge and the following measurements may be evaluated: Return wet-bulb and return air dry-bulb temperature measured at the evaporator coil (near 7, FIG. 1); Supply dry-bulb temperature measured at the outlet of the evaporator coil (near 8, FIG. 1); Condenser air entering temperature measured at the condenser coil (near 3, FIG. 1); Vapor temperature and Vapor pressure, both measured at compressor return (near 9, FIG. 1), Liquid temperature and Liquid pressure, both measured at condenser coil exit (near 5, FIG. 1).

For either FXV or TXV systems the following measurements may be evaluated: return (entering) wet-bulb and dry-bulb temperatures are measured at (7) at the inside coil (left) and supply dry-bulb is measured at (8). These measurements are used to lookup the target temperature split and diagnose proper airflow across the evaporator coil and recommend corrective steps to improve airflow or to check and correct refrigerant charge to provide optimal cooling capacity and energy efficiency. The airflow methodology is based on standard methods known to persons of ordinary skill in the arts.

The expanded temperature split table is used to evaluate the return and supply air enthalpy split used to determine the energy efficiency improvement based on Refrigerant Charge and Airflow (RCA) improvements. The temperature split is defined in Equation 1.

$$TS=t_r-t_s \qquad \text{Eq.1.}$$

Where,

TS=temperature split difference between return and supply air dry bulb (° F.), $t_r$=return air dry temperature (° F.), $t_s$=supply air dry bulb temperature (° F.).

For either FXV or TXV systems the following measurements are evaluated: Return wet-bulb and return air dry-bulb temperature measured at the evaporator coil (near 7, FIG. 1); Supply dry-bulb and supply air wet-bulb temperature measured at the outlet of the evaporator coil (near 8, FIG. 1); Condenser air entering temperature measured at the condenser coil (near 3, FIG. 1); Vapor temperature and Vapor pressure, both measured at compressor return (near 9, FIG. 1), Liquid temperature and Liquid pressure, both measured at condenser coil exit (near 5, FIG. 1). The measurements are used to lookup the target superheat and diagnose proper superheat and recommend corrective steps to check and correct refrigerant charge to provide optimal cooling capacity and energy efficiency. The superheat methodology is based on standard methods known to persons of ordinary skill in the arts.

The expanded superheat table is used to evaluate refrigerant charge. The actual superheat is defined in Equation 2.

$$SH_a = T_{suction} - T_{est} \quad \text{Eq. 2.}$$

Where, $SH_a$=actual superheat temperature difference between suction line and evaporator saturation temperature (° F.), $T_{suction}$=refrigerant suction line temperature (° F.), $T_{est}$=evaporator saturation temperature (° F.).

Prior art assumes the delta temperature split must be within a tolerance of plus (+) or minus (−) 3 F.

Expanded empirical target superheat values are provided in Table 3. Delta Superheat (DSH) is calculated using Equation 3.

$$DSH = SH_a - SH_t \quad \text{Eq. 3.}$$

Where, DSH=delta superheat temperature difference between actual and target superheat (° F.), $SH_t$=target superheat temperature from Table 4 based on return wet-bulb and dry-bulb temperature (° F.).

Prior art assumes the delta superheat must be within a tolerance of plus (+) or minus (−) 5 F (i.e., −5° F.≤DSH≤5° F.).

If target superheat ($SH_t$) is less than or equal to 7° F. and greater than or equal to 2° F. (lower limit), then to avoid overcharging the delta superheat tolerance is defined in Equation 4.

$$\text{Delta Superheat Tolerance} = 2° F. - SH_t \leq DSH \leq 12° F. - SH_t \quad \text{Eq. 4.}$$

Where expanded empirical target superheat table values are provided in Table 4.

Non-condensable diagnostics are evaluated based on a series of tests over a wide range of air temperatures entering the condensing unit. Tests were performed with 0.3 ounces nitrogen contamination (approximately 0.3% of unit charge by weight). The standard diagnostic for the presence of non-condensables is the value of condenser saturation temperature minus the ambient temperature of the air entering the condenser coil. Prior art refers to this as a Condenser saturation Over Ambient (COA) test. Values of the COA for the unit loaded with 0.3 oz of nitrogen are shown in FIG. 2 for the unit using the TXV and non-TXV devices with correct refrigerant charge (charge not adjusted for incorrect superheat or subcooling).

Figure 2:
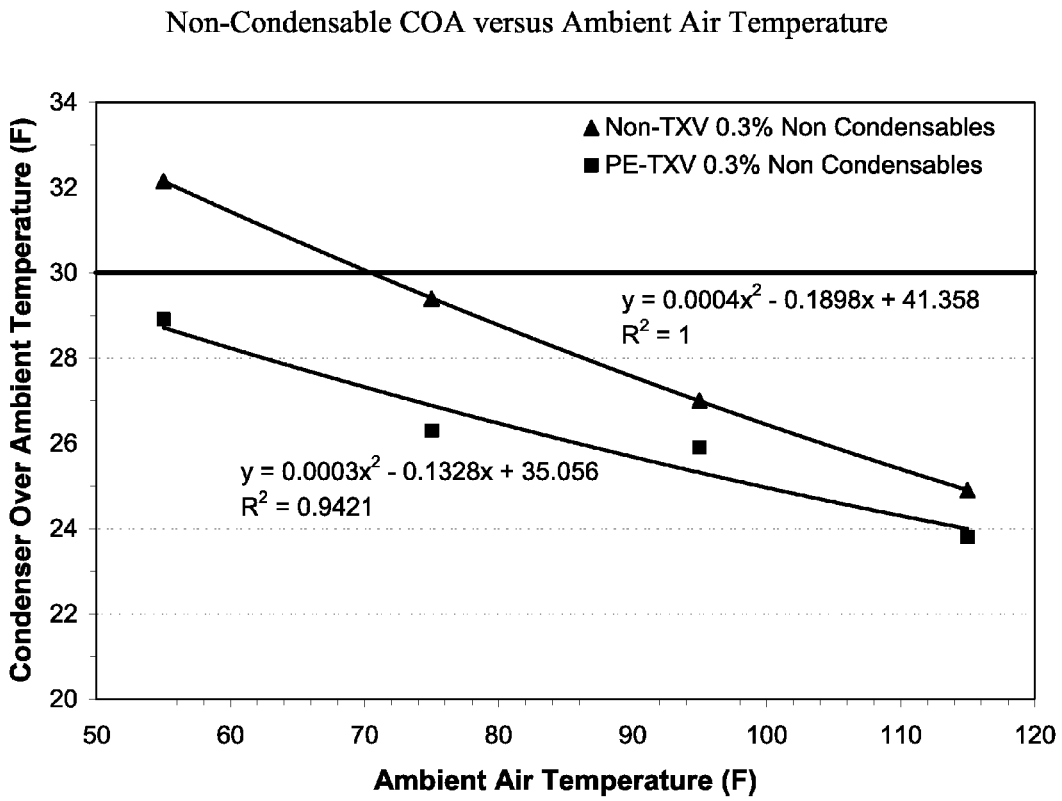
FIG. 2 shows a plot of non-condensable Condenser saturation Over Ambient (COA) versus ambient air temperature, according to the present invention.

FIG. 2 indicates that there is not a single value of COA that should be used for diagnostic testing of non-condensables. The prior art diagnostic rule for the presence of non-condensables is a nominal COA value of 30° F. This may be observed for the test unit using a non-TXV control device at lower ambient temperatures (less than 83° F.), but not for all ambient temperatures. The prior art nominal COA value of 30° F. is too high a threshold for the unit tested. For the TXV the COA never reaches a value as high as 30° F. For the non-TXV the 30° F. COA threshold is too high for outdoor air temperatures above 83° F.

It seems likely that the second observation would hold for most modern higher efficiency single-speed spit-system cooling systems. The nominal design COA for the properly charged test unit at the "A" test point was 15° F.±0.5° F. This was independent of the expansion device and whether or not the unit was tested assuming hot attic conditions or standard room temperature conditions surrounding the evaporator section. Non-condensables increased the condenser saturation temperature by an additional 11 to 13° F., depending on the expansion device. Given this, the prior art nominal COA of 30° F. is not applicable to all units. Older, less efficient units typically had smaller, less efficient condenser coils which would have generated a higher design COA value—say 20° F. instead of the test unit's 15° F.—when properly installed. For these units a 30° F. COA diagnostic value could be commensurate with a design COA of 20° F. plus the additional 11 to 13° F. increase associated with the presence of a non-condensable.

Diagnostics tests were developed by fitting a second degree polynomial to the condenser saturation data from the two data sets (TXV and non-TXV). This data was used along with data taken on the same unit in an over-charged condition and with a blocked condenser coil to develop diagnostic algorithms. The data for the over-charged condition and blocked condenser coil were included in the effort as these two faults have similar diagnostic characteristics. The resulting algorithms are described as follows. The algorithms include an offset to adjust for condenser heat exchanger surface area as a function of SEER rating.

Non-TXV Algorithm

If the SEER is greater than or equal to 10 and less than 13, then Equation 5 is used to evaluate the initial test measurement of the condenser saturation temperature minus condenser entering air temperature. Equation 6 is used to evaluate the final test measurement of the condenser saturation temperature minus condenser entering air temperature. Equation 7 is used to evaluate the actual subcooling and delta superheat values. Equation 8 is used to evaluate pass and/or fail criteria based on Equations 5 through 7 to determine if non condensables are present.

$$T1coa = IF(COA > [0.0004*(OAT\hat{}2) + 0.8102*(OAT) + T1_{offset} - (OAT)]), \text{"FAIL"}, \text{"PASS"}) \quad \text{Eq.5}$$

Where,

T1coa=initial test measurement of condenser over ambient temperature (COA),

COA=condenser saturation minus condenser entering air temperature (° F.),

OAT=outdoor air temperature, i.e., condenser entering air temperature (° F.), $T1_{offset}$=40.458, if SEER>=13, $T1_{offset}$=41.458, if 10<=SEER<13, $T1_{offset}$=42.458, if SEER<10, and SEER=rated Seasonal Energy Efficiency Ratio.

$$T2coa = IF(COA > [0.0004*(OAT\hat{}2) + 0.8102*(OAT) + T2_{offset} - (OAT)]), \text{"FAIL"}, \text{"PASS"}) \quad \text{Eq. 6}$$

Where,

T2coa=final test measurement of COA, $T2_{offset}$=38.458, if SEER>=13, $T2_{offset}$=39.458, if 10<=SEER<13, and $T2_{offset}$=40.458, if SEER<10.

$$T3asc,dsh = IF(AND[ASC > 18F, DSH > -14.6F]), \text{"FAIL"}, \text{"PASS"}) \quad \text{Eq. 7}$$

Where,

T3asc,dsh=test for actual subcooling (ASC) and delta superheat (DSH),

ASC=condenser saturation temperature minus liquid line temperature (° F.),

DSH=actual superheat (ASH) minus target superheat (TSH) temperature (° F.),

ASH=suction line temperature minus evaporator saturation temperature (° F.), and TSH=target superheat from look up table based on return wet bulb and condenser entering air temperature (OAT).

$$T4nc=IF(AND(OR(T1coa=\text{"FAIL"},T2coa=\text{"FAIL"}),T3asc,dsh=\text{"FAIL"}),\text{"Non-condensable (NC)"},\text{"PASS"}) \quad \text{Eq. 8}$$

Where,

T4nc=test for non-condensables (NC), either PASS or NC.

The result of applying the algorithm to the additional laboratory test data that includes over-charged conditions and blocked condenser coil is shown in Tables 9 and 10. The Column labeled "T4nc" indicates "NC" when a non-condensable is present and "PASS" when not. Algorithms correctly identified the non-condensable condition for units with 0.3% or 1% nitrogen in the system, but not for all other tests including those with over-charge or condenser coil blockage as shown in Table 10. For the +40% charge test (Run 183b) and 80% condenser coil blockage (Run 190-2) the COA is sufficient to produce a "FAIL" for Tests T1coa and T2coa. The T3asc,dsh test is "PASS", providing the correct overall diagnostic result.

TABLE 9

Non-TXV Tests for Baseline and Non-condensables

| Description | OAT | ASC | DSH | COA | coa1 | Coa2 | T1coa | T2coa | T3asc,dsh | T4nc | Test |
|---|---|---|---|---|---|---|---|---|---|---|---|
| Baseline no NC | 95 | 10.26 | −2.67 | 16.1 | 26.94 | 24.94 | PASS | PASS | PASS | PASS | 189 |
| Baseline no NC | 115 | 3.11 | −0.63 | 15.11 | 24.82 | 22.82 | PASS | PASS | PASS | PASS | 412-2 |
| 0.3% NC | 115 | 19.89 | −4.72 | 24.87 | 24.82 | 22.82 | FAIL | FAIL | FAIL | NC | 502 |
| 0.3% NC | 95 | 25.35 | 9.3 | 28.9 | 26.94 | 24.94 | FAIL | FAIL | FAIL | NC | 501 |
| 0.3% NC | 75 | 28.13 | 10.52 | 29.4 | 29.37 | 27.37 | FAIL | FAIL | FAIL | NC | 503 |
| 0.3% NC | 55 | 31.41 | 6.35 | 32.15 | 32.13 | 30.13 | FAIL | FAIL | FAIL | NC | 504 |
| ~1.0% NC | 95 | 41.95 | 0.51 | 46.81 | 26.94 | 24.94 | FAIL | FAIL | FAIL | NC | 501X |

TABLE 10

Non-TXV Tests for Correct and Over-charge and Condenser Coil Blockage

| Description | OAT | ASC | DSH | COA | coa1 | Coa2 | T1coa | T2coa | T3asc,dsh | T4nc | Test |
|---|---|---|---|---|---|---|---|---|---|---|---|
| Correct Charge | 95 | 9.7 | −1.4 | 17.7 | 26.94 | 24.94 | PASS | PASS | PASS | PASS | 53 |
| +5% Charge | 95 | 14.3 | −10.2 | 18.6 | 26.94 | 24.94 | PASS | PASS | PASS | PASS | 59b |
| +10% Charge | 95 | 16.5 | −10.4 | 20.1 | 26.94 | 24.94 | PASS | PASS | PASS | PASS | 60a |
| +20% Charge | 95 | 17.4 | −10.4 | 20.4 | 26.94 | 24.94 | PASS | PASS | PASS | PASS | 61a |
| +30% Charge | 95 | 17.9 | −10.4 | 21 | 26.94 | 24.94 | PASS | PASS | PASS | PASS | 62 |
| +40% Charge | 95 | 19.3 | −10.3 | 21.9 | 26.94 | 24.94 | PASS | PASS | FAIL | PASS | 63 |
| Correct Charge | 82 | 13.8 | 4.0 | 16.3 | 28.48 | 26.48 | PASS | PASS | PASS | PASS | 178-2b |
| +5% Charge | 82 | 20.8 | −17.7 | 22.1 | 28.48 | 26.48 | PASS | PASS | PASS | PASS | 179b |
| +10% Charge | 82 | 22.6 | −17.8 | 23.7 | 28.48 | 26.48 | PASS | PASS | PASS | PASS | 180b |
| +20% Charge | 82 | 23.4 | −17.8 | 24.4 | 28.48 | 26.48 | PASS | PASS | PASS | PASS | 181b |
| +30% Charge | 82 | 24.6 | −17.2 | 26 | 28.48 | 26.48 | PASS | FAIL | PASS | PASS | 182b |
| +40% Charge | 82 | 31.6 | −17.1 | 32.8 | 28.48 | 26.48 | FAIL | FAIL | PASS | PASS | 183b |
| 50% Condenser Coil Blockage | 95 | 9.67 | −14.01 | 23.33 | 26.94 | 24.94 | PASS | PASS | PASS | PASS | 191-2 |
| 80% Condenser Coil Blockage | 95 | 5.81 | −14.18 | 40.7 | 26.94 | 24.94 | FAIL | FAIL | PASS | PASS | 190-2 |

Finally, the logic equations are applied to laboratory test data shown in Table 11. The baseline run 189 has no non-condensables. Runs 197 and 198 contain an estimated 0.3% by weight of nitrogen (weight estimated, not weighed in as for tests 501-505). Run 198 has 5.4% charge removed to increase delta superheat (DSH) from 1.7° F. to 12.9° F. per the current CEC refrigerant charge protocol. For Runs 197 and 198 (with or without the charge removal) the logic equations indicate the presence of non-condensables (NC).

TABLE 11

Non-TXV Tests for Non-condensable with Correct Charge and 5.9 Oz. Removal

| Description | OAT | ASC | DSH | COA | Coa1 | coa2 | T1coa | T2coa | T3asc,dsh | T4nc | Test |
|---|---|---|---|---|---|---|---|---|---|---|---|
| Baseline no NC | 95 | 10.26 | −2.67 | 16.1 | 26.94 | 24.94 | PASS | PASS | PASS | PASS | 189 |
| 0.3% NC | 95 | 24.48 | −12.89 | 27.06 | 26.94 | | FAIL | | FAIL | NC | 197 |
| 0.3% NC −5.4% Charge | 95 | 22.84 | −1.66 | 25.64 | | 24.94 | | FAIL | FAIL | NC | 198 |

Figure 3:
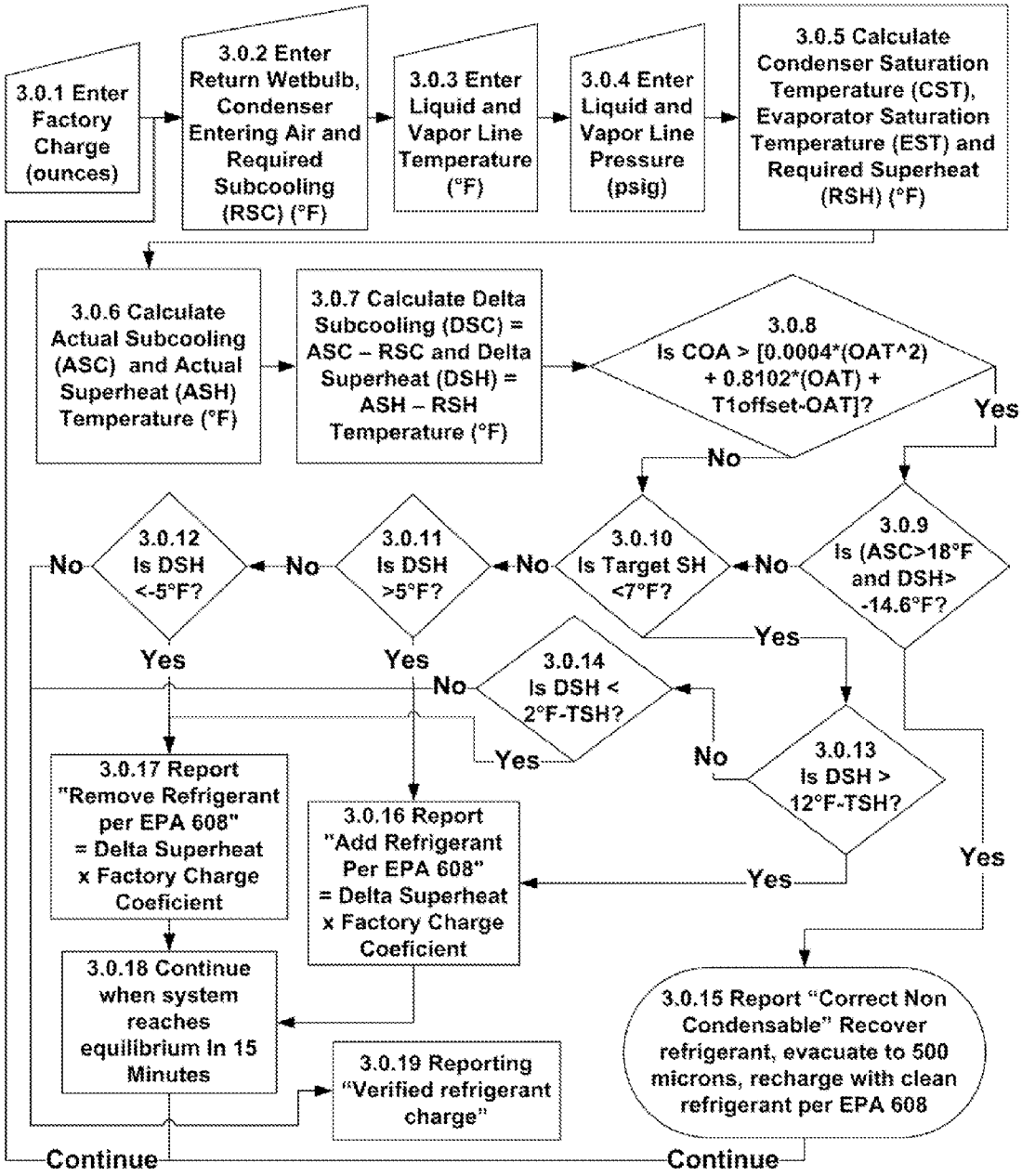
FIG. 3 shows a flow chart to distinguish non-condensables from over-charge for non-TXV equipped air conditioners or heat pumps in cooling mode, according to the present invention.

FIG. 3 illustrates a method to differentiate non-condensables from over-charge for non-TXV equipped air conditioners or heat pumps in cooling mode. The method is first performed includes the initial steps of:

setting T1offset to an initial value:
- if SEER>=13, then T1offset=40.458;
- if 10<=SEER<13, then T1offset=41.458; and
- if SEER<10, then T1offset=42.458;

entering factory charge (ounces);

entering return wetbulb, condenser entering air and Required Subcooling (RSC) (° F.);

entering liquid and vapor line temperature (° F.);

entering liquid and vapor line pressure (psig);

calculating Condenser Saturation Temperature (CST), Evaporator Saturation Temperature (EST) and Required Superheat (RSH) (° F.);

calculating Actual Subcooling (ASC) and Actual Superheat Temperature (ASH) (° F.);

calculating Delta Subcooling (DSC)=ASC−RSC and Delta Superheat;

calculating (DSH)=ASH−RSH Temperature (° F.);

if:

COA>[0.0004*(OAT**2)+0.8102*(OAT)−*T*1offset−OAT]; and

ASC>18 deg F.; and

DSH>−14.6 deg F., then,
- reporting "Correct non-condensables";
  - recovering refrigerant;
- removing non-condensables;
- evacuating to 500 microns;
- recharging; and
- continue testing;

otherwise:
- if:
  - TSH<7deg F.; and
  - DSH>(12 deg F.−TSH)
  - or:
  - TSH not<7 deg F.; and
  - DSH>5 deg F.:
- then:
  - reporting "Add Refrigerant per EPA 608"=DSH x Factory Charge Coefficient; and
  - continuing when system reaches equilibrium in 15 minutes;
- if:
  - TSH<7deg F.; and
  - DSH<(2 deg F.−TSH);
  - or,
  - TSH not<7 deg F.; and
  - DSH<−5 deg F.:
- then:
  - reporting "Remove Refrigerant per EPA 608"=DSH x Factory Charge Coefficient; and
  - continuing when system reaches equilibrium in 15 minutes;
- if:
  - TSH<7 deg F.; and
  - DSH<(2 deg F.−TSH)
  - or
  - TSH not<7 deg F.; and
  - DSH<−5 deg F.
- then:
  - reporting "Remove Refrigerant per EPA 608"=Delta Superheat x, and
  - continuing when system reaches equilibrium in 15 minutes;
- if;
  - DSH<or =+5 deg F.; and
  - DSH>or =−5 deg F.
- then:
  - reporting "Verified refrigerant charge"; and
  - ending testing;

if after initial testing:
- non-condensables are diagnosed and refrigerant is recovered to correct non-condensables, followed by evacuation to 500 microns and recharge; or
- refrigerant is added or removed,
- followed by system operation until equilibrium conditions are achieved, then repeat the above steps replacing T1offset with T2 offset computed as:
- if SEER>=13, then T2offset=38.458;
- if 10<=SEER<13, then T2offset=39.458; and
- if SEER<10; T2offset=40.458.

The following algorithms described in Equations 9 through 12 are developed from test data in which the TXV was used as the control device. The algorithms include an offset to adjust for condenser heat exchanger surface area as a function of SEER rating. Equation 9 is used to evaluate the initial test measurement of the condenser saturation temperature minus condenser entering air temperature. Equation 10 is used to evaluate the final test measurement of the condenser saturation temperature minus condenser entering air temperature. Equation 11 is used to evaluate the actual subcooling and delta superheat values. Equation 12 is used to evaluate pass and/or fail criteria based on Equations 9 through 11 to determine if non condensables are present.

TXV Algorithm $$T5\text{coa}=\text{IF}(\text{COA}>[0.0003*(\text{OAT}\hat{}2)+0.8672*(\text{OAT})+T5_{offset}-(\text{OAT})]),\text{"FAIL"},\text{"PASS"}) \quad \text{Eq. 9}$$

Where,
- T5coa=initial test measurement of condenser over ambient temperature (COA),
- $T5_{offset}$=35.056, if SEER>=13,
- $T5_{offset}$=36.056, if 10<=SEER<13, and
- $T5_{offset}$=37.056, if SEER<10.

$$T6\text{coa}=\text{IF}(\text{COA}>[0.0003*(\text{OAT}\hat{}2)+0.8672*(\text{OAT})+T6_{offset}-(\text{OAT})]),\text{"FAIL"},\text{"PASS"}) \quad \text{Eq. 10}$$

Where,
- T6coa=final test measurement of COA,
- $T6_{offset}$=33.056, if SEER>=13,
- $T6_{offset}$=34.056, if 10<=SEER<13, and
- $T6_{offset}$=35.056, if SEER<10.

$$T7\text{dsc,dsh}=\text{IF}(\text{AND}[\text{DSC}>10\text{F},\text{DSH}>-13\text{F}]),\text{"FAIL"},\text{"PASS"}) \quad \text{Eq. 11}$$

Where,
- T7dsc,dsh=test for delta sub-cooling (DSC) and delta superheat (DSH),
- DSC=actual sub-cooling (ASC) minus target sub-cooling (TSC) (° F.),
- TSC=target sub-cooling from manufacturer data (° F.).

$$T8\text{nc}=\text{IF}(\text{AND}(\text{OR}(T5\text{coa}=\text{"FAIL"},T6\text{coa}=\text{"FAIL"}),T7\text{dsc,dsh}=\text{"FAIL"}),\text{"Non-condensable(NC)"},\text{"PASS"}) \quad \text{Eq. 12}$$

Where, T8nc=test for non-condensables (NC), either PASS or NC.

The logic equations were applied to the laboratory test data shown in Tables 12 and 13. As the data in the tables indicate, the algorithm was able to identify a non-condensable and differentiate that condition from over-charge faults.

TABLE 12

TXV Laboratory Tests for Baseline and Non-condensables

| Description | OAT | DSC | DSH | COA | coa1 | coa2 | T5coa | T6coa | T7dsc,dsh | T8nc | Test |
|---|---|---|---|---|---|---|---|---|---|---|---|
| Baseline no NC | 95 | −2.74 | −14.37 | 13.76 | 25.15 | 23.15 | PASS | PASS | PASS | PASS | 303 |
| 0.3% NC | 115 | 11.2 | 5.05 | 23.77 | 23.75 | 21.75 | FAIL | FAIL | FAIL | NC | 506 |
| 0.3% NC | 95 | 14.98 | −4.4 | 25.9 | 25.15 | 23.15 | FAIL | FAIL | FAIL | NC | 505 |
| 0.3% NC | 75 | 17.6 | −12.93 | 26.31 | 26.78 | 24.78 | PASS | FAIL | FAIL | NC | 507 |
| 0.3% NC | 55 | 21.1 | −8.36 | 28.91 | 28.66 | 26.66 | FAIL | FAIL | FAIL | NC | 508 |
| Baseline no NC | 95 | −2.74 | −14.37 | 13.76 | 25.15 | 23.15 | PASS | PASS | PASS | PASS | 303 |

TABLE 13

TXV Laboratory Tests for Correct Charge and Over-charge

| Description | OAT | DSC | DSH | COA | coa1 | coa2 | T5coa | T6coa | T7dsc,dsh | T8nc | Test |
|---|---|---|---|---|---|---|---|---|---|---|---|
| Correct Charge | 95 | −1.0 | −11.9 | 14.6 | 25.15 | 23.15 | PASS | PASS | PASS | PASS | 23 |
| +5% Charge | 95 | −4.9 | −14.2 | 13 | 25.15 | 23.15 | PASS | PASS | PASS | PASS | 33 |
| +10% Charge | 95 | 12.9 | −12.1 | 22.4 | 25.15 | 23.15 | PASS | PASS | FAIL | PASS | 36 |
| +20% Charge | 95 | 18.9 | −13.1 | 27.8 | 25.15 | 23.15 | FAIL | FAIL | PASS | PASS | 37 |
| +30% Charge | 95 | 22.3 | −14.9 | 31.6 | 25.15 | 23.15 | FAIL | FAIL | PASS | PASS | 40 |
| +40% Charge | 95 | 26.1 | −14.8 | 34.3 | 25.15 | 23.15 | FAIL | FAIL | PASS | PASS | 41 |

Figure 4:
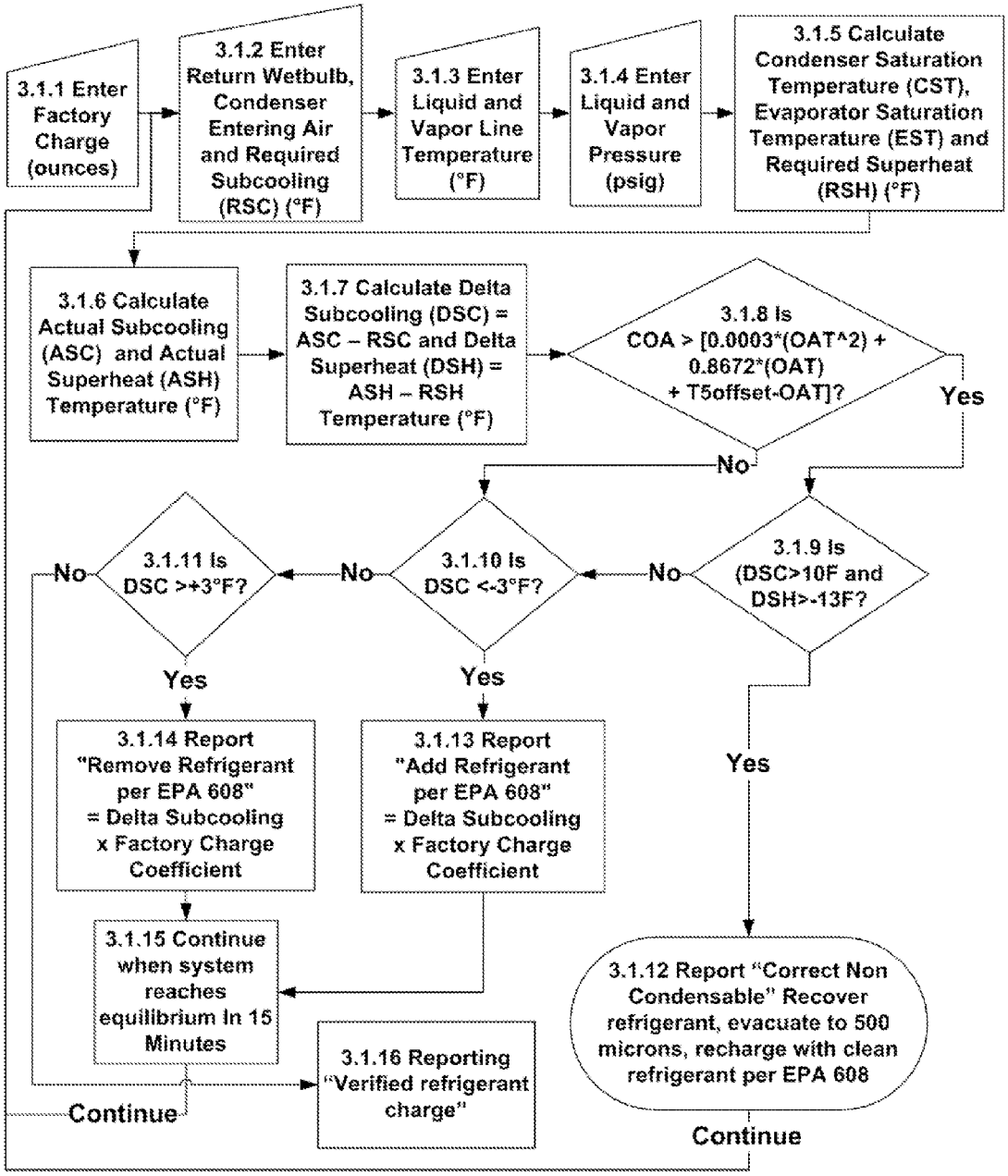
FIG. 4 shows a flow chart to distinguish non-condensables from over-charge for TXV equipped air conditioners or heat pumps in cooling mode, according to the present invention.

FIG. 4 illustrates a method to differentiate non-condensables from over-charge for TXV equipped air conditioners or heat pumps in cooling mode. The method is first performed includes the initial steps of:

setting T5offset to an initial value:
- if SEER>=13, then T5offset=35.056;
- if 10<=SEER<13, then T5offset=36.056; and
- if SEER<10, then T5offset=37.056;

entering factory charge (ounces);

entering return wetbulb, condenser entering air and Required Subcooling (RSC) (° F.);

entering liquid and vapor line temperature (° F.);

entering liquid and vapor line pressure (psig);

calculating Condenser Saturation Temperature (CST), Evaporator Saturation Temperature (EST) and Required Superheat (RSH) (° F.);

calculating Actual Subcooling (ASC) and Actual Superheat Temperature (ASH) (° F.);

calculating Delta Subcooling (DSC)=ASC−RSC;

calculating Delta Superheat (DSH)=ASH−RSH Temperature (° F.);

if:

$$\text{initial COA} > [0.0003*(\text{OAT}^2)+0.8672*(\text{OAT})+T5_{offset}-(\text{OAT})]; \text{ and}$$

DSC>10 deg F.; and

DSH>−13 deg F., then,
- reporting "Correct non-condensables";
- recovering refrigerant;
- removing non-condensables;
- evacuating to 500 microns;
- recharging; and
- continuing testing;

otherwise:
- if
  - DSC<−3 deg F.:
- then:
  - reporting "Add Refrigerant per EPA 608"=DSC x Factory Charge Coefficient;
- if:
  - DSC>+3 deg F.:
- then:
  - reporting "Remove Refrigerant per EPA 608"=DSC x Factory Charge; and
  - continuing when system reaches equilibrium in 15 minutes;
- if:
  - DSC<or =+3 deg F.; and
  - DSC>or =−3 deg F.
- then:
  - reporting "Verified refrigerant charge"; and
  - ending testing;

if after initial testing:
- non-condensables are diagnosed and refrigerant is recovered to correct non-condensables, followed by evacuation to 500 microns and recharge; or
- refrigerant is added or removed,
- followed by system operation until equilibrium conditions are achieved, then repeat the above steps replacing T5offset with T6offset computed as:
- if SEER>=13, then T6offset=33.056;
- if 10<=SEER<13, then T6offset=34.056; and
- if SEER<10, then T6offset=35.056.

Figure 5:
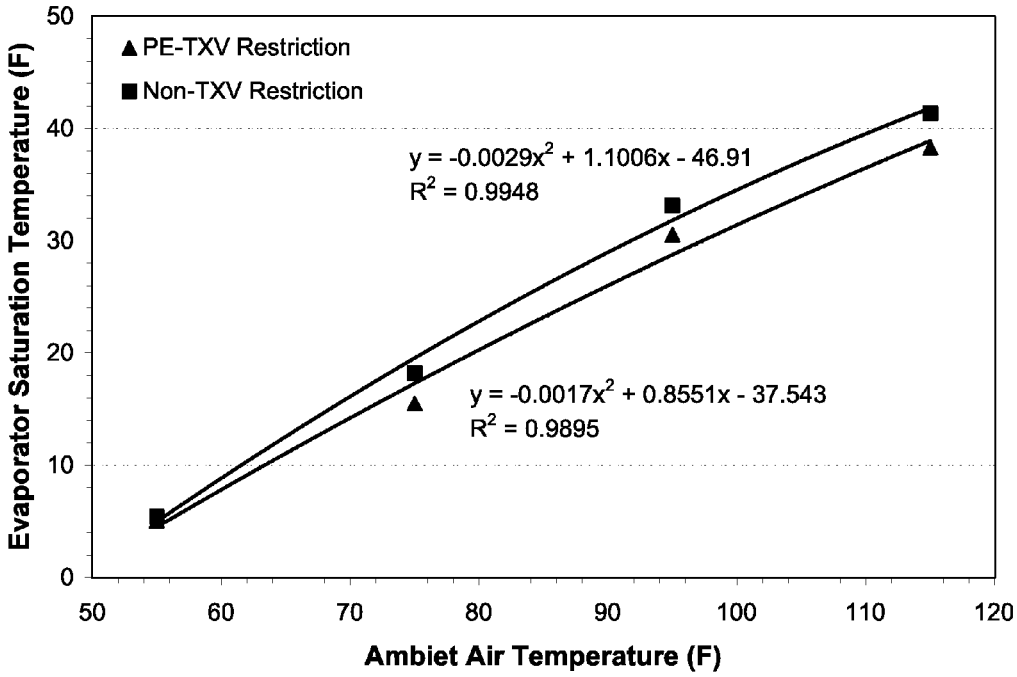
FIG. 5 shows restriction evaporator saturation versus condenser entering air temperature, according to the present invention.

Refrigerant restriction diagnostics are evaluated based on a series of tests conducted with a restriction introduced by partially shutting a valve just before the expansion device. The evaporator saturation temperatures with a restriction versus condenser entering air temperatures are shown in FIG. 5 for the system using a TXV and non-TXV as the control device, loaded to their correct refrigerant charge. For the non-TXV system, the restriction lead to an EST is 14.7° F. less than the baseline and a 19.2% increase in the liquid minus suction pressure ratio. The TXV system showed a decrease in the EST of 18° F. and a 15.4% increase in the pressure ratio.

Diagnostics tests were developed by fitting a second degree polynomial to the evaporator saturation temperature data from the non-TXV data. These data were used along with data taken on the same unit for under-charged conditions to develop the diagnostic algorithms. The data for the under-charged conditions are included as these two faults have similar diagnostic characteristics. The non-TXV algorithms are described in Equations 13 through 15. The algorithms include an offset to adjust for evaporator heat exchanger surface area as a function of SEER rating. Equation 13 is used to evaluate the initial and final test measurement of the evaporator saturation temperature. Equation 14 is used to evaluate the actual subcooling and delta superheat values. Equation 15 is used to evaluate pass and/or fail criteria based on Equations 13 and 14 to determine if refrigerant restrictions are present.

Non-TXV Algorithm $$T1est=IF(EST<[-0.0029*(OAT^2)+1.1006*(OAT)-T7_{offset}]),\text{"FAIL"},\text{"PASS"}) \quad \text{Eq.13}$$

Where,

T1est=initial and final test of evaporator saturation temperature (EST) measurement, EST=evaporator saturation temperature (° F.) measurement, OAT=outdoor air temperature, i.e., condenser entering air temperature (° F.), $T7_{offset}$=44.91, if SEER>=13, $T7_{offset}$=43.91, if 10<=SEER<13, and $T7_{offset}$=42.91, if SEER<10.

$$T2asc,dsh=IF(AND[ASC>7° F.,DSH>5° F.]),\text{"FAIL"},\text{"PASS"}) \quad \text{Eq. 14}$$

Where,

T2asc,dsh=test for actual subcooling (ASC) and delta superheat (DSH),

ASC=condenser saturation temperature minus liquid line temperature (° F.),

DSH=actual superheat (ASH) minus required superheat (TSH),

ASH=suction line temperature minus evaporator saturation temperature (° F.), and TSH=target superheat from look up table based on return wet bulb and condenser entering air temperature (OAT).

$$T3rr=IF(AND(T1est=\text{"FAIL"},T2asc,dsh=\text{"FAIL"}),\text{"Refrigeration Restrictions (RR)"},\text{"PASS"}) \quad \text{Eq. 15}$$

Where, T3rr=test for restrictions (RR), either PASS or RR.

FIG. 5 indicates that there is not a single value of EST that should be used for diagnostic testing of restrictions. The prior art diagnostic rule for the presence of restrictions is an EST value of 28° F. This may be observed for test units using TXV or non-TXV control devices at ambient air temperatures from 88 to 95° F., but not for all ambient temperatures. Second, the prior art nominal EST threshold value of 28° F. is too high for ambient temperatures less than 90° F. for the test unit.

It seems likely that the second observation would hold for most modern higher efficiency single-speed spit-system cooling systems. The nominal design EST for the properly charged test unit at the "A" test point was 45° F.±5° F. This was independent of the expansion device and whether or not the unit was tested assuming hot attic conditions or standard room temperature conditions surrounding the evaporator section. Restrictions lowered the EST by an additional 14 to 18° F., depending on the expansion device in use. Given this, the prior art nominal EST restriction threshold of 28° F. cannot be used to properly diagnose refrigerant restrictions.

The logic equations are applied to the laboratory test data shown in Tables 14 and 15. The Column labeled "T3rr" indicates "RR" for the runs with restrictions and "PASS" for all other tests including the non-TXV laboratory tests for low airflow and under-charge shown in Table 15. For the −40% charge test (Run 188-2) the EST generates a "FAIL" for T1est, but the T3asc,dsh is "PASS" indicating that the logic equations and algorithms can differentiate restrictions from under-charge for the non-TXV equipped air conditioner.

TABLE 14

Non-TXV Laboratory Tests for Baseline and Restrictions

| Description | OAT | ASC | DSH | EST | est1 | T1est | T2asc,dsh | T3rr | Test |
|---|---|---|---|---|---|---|---|---|---|
| Correct Charge | 95 | 10.26 | −2.67 | 47.86 | 33.5 | PASS | PASS | PASS | 189 |
| Moderate Restriction | 95 | 16.4 | 32.84 | 33.15 | 33.5 | FAIL | FAIL | RR | 701 |
| Moderate Restriction | 115 | 12.26 | 24.81 | 41.36 | 43.3 | FAIL | FAIL | RR | 702 |
| Moderate Restriction | 75 | 10.64 | 35.92 | 18.2 | 21.3 | FAIL | FAIL | RR | 703 |
| Moderate Restriction | 55 | 9.87 | 32.49 | 5.41 | 6.9 | FAIL | FAIL | RR | 704 |

TABLE 15

Non-TXV Laboratory Tests for Correct Charge, Low Airflow, and Under-charge

| Description | OAT | ASC | DSH | EST | est1 | T1est | T2asc,dsh | T3rr | Test |
|---|---|---|---|---|---|---|---|---|---|
| Correct Charge | 95 | 9.7 | −1.4 | 48.2 | 33.5 | PASS | PASS | PASS | 53 |
| −10% Low Airflow | 95 | 9.2 | 3.2 | 46.9 | 33.5 | PASS | PASS | PASS | 64 |
| −23% Low Airflow | 95 | 9.4 | 0.7 | 46.3 | 33.5 | PASS | PASS | PASS | 65 |
| −36% Low Airflow | 95 | 8.7 | −4.4 | 45.6 | 33.5 | PASS | PASS | PASS | 66 |
| −5% Charge | 95 | 3.4 | 15.6 | 44.3 | 33.5 | PASS | PASS | PASS | 54 |
| −10% Charge | 95 | 0.6 | 32.4 | 35.4 | 33.5 | PASS | PASS | PASS | 55 |
| −20% Charge | 95 | 0.1 | 40.8 | 28.5 | 33.5 | FAIL | PASS | PASS | 56a |
| −30% Charge | 95 | −0.6 | 54.3 | 15.3 | 33.5 | FAIL | PASS | PASS | 57a |
| −40% Charge | 95 | −0.9 | 61.0 | 8.1 | 33.5 | FAIL | PASS | PASS | 58 |
| Correct Charge | 82 | 13.8 | 1.1 | 44.3 | 25.8 | PASS | PASS | PASS | 178-2 |
| −5% Charge | 82 | 9.5 | 8.7 | 42 | 25.8 | PASS | FAIL | PASS | 184-2 |
| −10% Charge | 82 | 5.8 | 15.8 | 38.3 | 25.8 | PASS | PASS | PASS | 185-2 |
| −20% Charge | 82 | 1.3 | 36.0 | 23.5 | 25.8 | FAIL | PASS | PASS | 186-2 |
| −30% Charge | 82 | -0.8 | 42.5 | 14 | 25.8 | FAIL | PASS | PASS | 187-2 |
| −40% Charge | 82 | -1.0 | 54.0 | 7 | 25.8 | FAIL | PASS | PASS | 188-2 |

Figure 6:
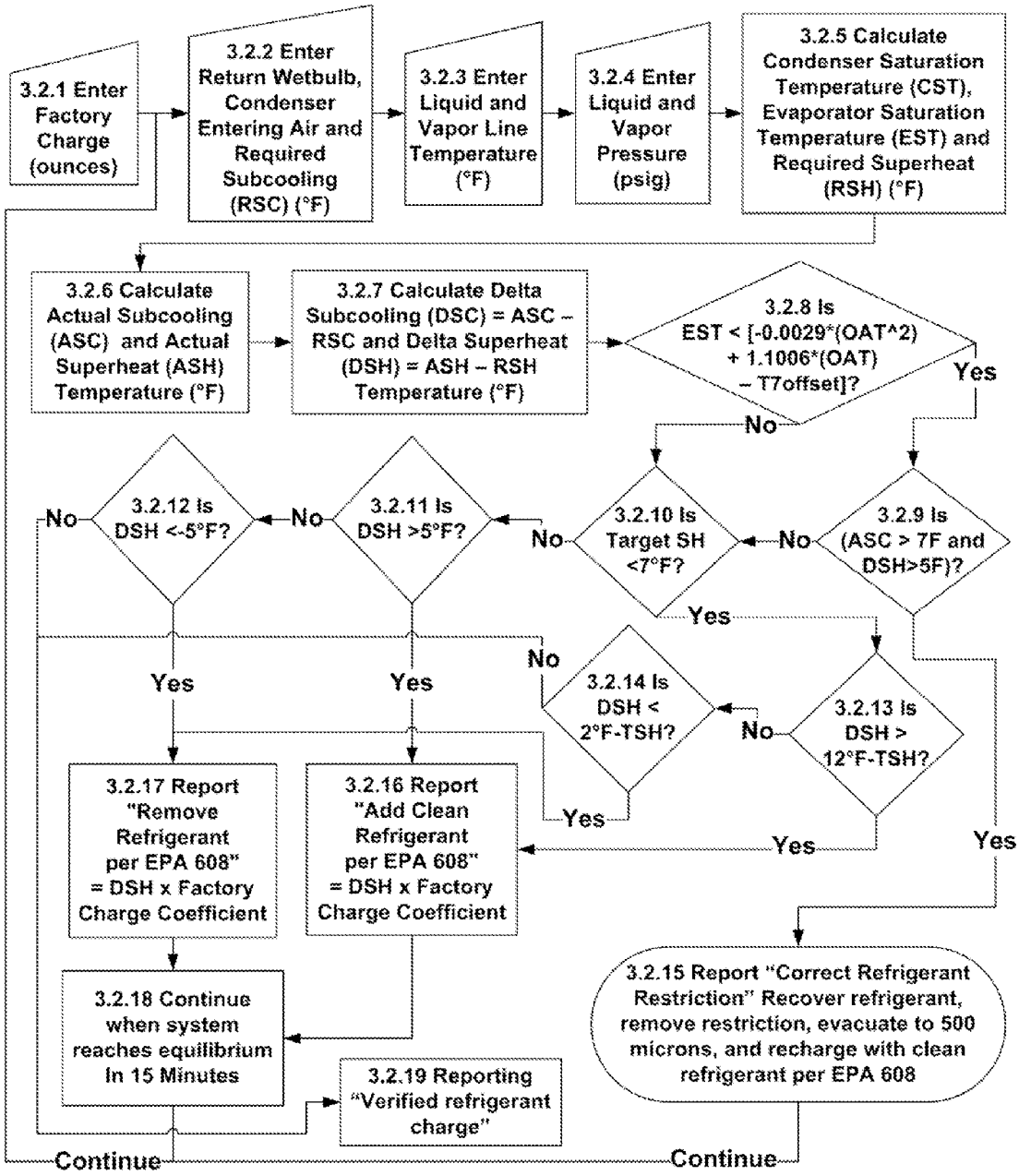
FIG. 6 shows flow chart to distinguish refrigerant restrictions from under-charge for non-TXV equipped air conditioners or heat pumps in cooling mode, according to the present invention.

FIG. 6 illustrates a method to differentiate refrigerant restrictions from under-charge for non-TXV equipped air conditioners or heat pumps in cooling mode. The method includes:

entering factory charge (ounces);

entering return wetbulb, condenser entering air and Required Subcooling (RSC) (° F.);

entering liquid and vapor line temperature (° F.);

entering liquid and vapor line pressure (psig);

calculating Condenser Saturation Temperature (CST), Evaporator Saturation Temperature (EST) and Required Superheat (RSH) (° F.);

calculating Actual Subcooling (ASC) and Actual Superheat Temperature (ASH) (° F.);

calculating Delta Subcooling (DSC)=ASC−RSC;

calculating Delta Superheat (DSH)=ASH−RSH Temperature (° F.)

if:

$$EST>[-0.0029*(OAT^2)+1.1006*(OAT)-T7_{offset}];\text{ and}$$

ASC>7 deg F.; and
DSH>5 deg F.,
where:
if SEER>=13, then T7offset=44.91;
if 10<=SEER<13, then T7offset=43.91; and
if SEER<10, then T7offset=42.91;
then,
reporting "Correct Refrigerant Restriction";
recovering refrigerant;
removing restriction;
evacuating to 500 microns;
recharging; and
continuing testing;
otherwise:
if:
TSH<7 deg F.; and
DSH>(12 deg F.−TSH)
or:
TSH not<7 deg F.; and
DSH>5 deg F.:
then:
reporting "Add Refrigerant per EPA 608"=DSH x Factory Charge Coefficient; and
continuing when system reaches equilibrium in 15 minutes;
if:
TSH<7deg F.; and
DSH not>(12 deg F.−TSH); and
DSH<(2 deg F.−TSH)
or
TSH not<7 deg F.; and
DSH not>5 deg F.; and
DSH<−5 deg F.,
then:
reporting "Remove Refrigerant per EPA 608"=Delta Superheat x, and
continuing when system reaches equilibrium in 15 minutes;
if;
TSH not<7 deg; and
DSH<or =+5 deg F.; and
DSH>or =−5 deg F.
then:
reporting "Verified refrigerant charge"; and
ending testing;
end.

Diagnostics tests were developed by fitting a second degree polynomial to the evaporator saturation temperature data from the TXV test data. This data were used along with data taken on the same unit in an under-charged condition to develop the diagnostic algorithms. The data for the under-charged conditions are included as these two faults have similar diagnostic characteristics. Restriction diagnostic algorithms for the air conditioning system controlled by a TXV are developed in a similar manner and are shown in equations 16-18. The algorithms include an offset to adjust for evaporator heat exchanger surface area as a function of SEER rating. Equation 16 is used to evaluate the initial and final test measurement of the evaporator saturation temperature. Equation 17 is used to evaluate the actual subcooling and delta superheat values. Equation 18 is used to evaluate pass and/or fail criteria based on Equations 16 and 17 to determine if refrigerant restrictions are present.

TXV Algorithm $$T4est=IF(EST<[-0.0017*(OAT^2)+0.855*(OAT)-T8_{offset}]),\text{"FAIL"},\text{"PASS"}) \quad \text{Eq.16}$$

Where,

T4est=test of evaporator saturation temperature (EST) measurement,

EST=evaporator saturation temperature (° F.) measurement,

OAT=outdoor air temperature, i.e., condenser entering air temperature (° F.), $T8_{offset}$=35.043, if SEER>=13, $T8_{offset}$=34.043, if 10<=SEER<13, and $T8_{offset}$=33.043, if SEER<10.

$$T5dsc,dsh=IF(AND[OR(ASC>7°\ F.,DSC>-3°\ F.),DSH>5°\ F.]),\text{"FAIL"},\text{"PASS"}) \quad \text{Eq.17}$$

Where,

T5dsc,dsh=test for delta subcooling (DSC) and delta superheat (DSH),

DSC=delta subcooling equals actual subcooling (ASC) minus target subcooling (TSC) temperature (° F.), TSC=target subcooling from manufacturer data (° F.).

DSH=actual superheat (ASH) minus target superheat (TSH) temperature (° F.),

ASH=suction line temperature minus evaporator saturation temperature (° F.), and TSH=target superheat from look up table based on return wet bulb and condenser entering air temperature (OAT).

$$T6nc=IF(AND(T4est=\text{"FAIL"},T5asc,dsh=\text{"FAIL"}),\text{"Refrigeration Restrictions (RR)"},\text{"PASS"}) \quad \text{Eq. 18}$$

Where, T6rr=test for restrictions (RR), either PASS or RR.

The TXV diagnostic algorithms were applied to the laboratory test data as shown in Tables 16 and 17. For the −40% charge test (Run 52, Table 18) the EST generated a "FAIL" for T4est, but the T5asc,dsh is "PASS" indicating that the logic equations and algorithms can differentiate restrictions from under-charge for the TXV equipped air conditioner.

TABLE 16

TXV Laboratory Tests for Baseline and Restrictions

| Description | OAT | DSC | DSH | EST | est1 | T4est | T5asc,dsh | T6rr | Test |
|---|---|---|---|---|---|---|---|---|---|
| Correct Charge | 95 | −2.74 | −14.37 | 48.46 | 30.8 | PASS | PASS | PASS | 303 |
| Moderate Restriction | 95 | 6 | 36.69 | 30.5 | 30.8 | FAIL | FAIL | RR | 801 |
| Moderate Restriction | 115 | 5.08 | 37.6 | 38.3 | 40.8 | FAIL | FAIL | RR | 802 |
| Moderate Restriction | 75 | 2.19 | 39 | 15.15 | 19.5 | FAIL | FAIL | RR | 803 |
| Moderate Restriction | 55 | 2.31 | 33.38 | 5.07 | 6.8 | FAIL | FAIL | RR | 804 |

TABLE 17

TXV Laboratory Tests for Correct Charge and Under-charge

| Description | OAT | DSC | DSH | EST | est1 | T4est | T5asc,dsh | T6rr | Test |
|---|---|---|---|---|---|---|---|---|---|
| Correct Charge | 95 | −1.0 | −10.2 | 48.2 | 30.8 | PASS | PASS | PASS | 23 |
| −5% Charge | 95 | −7.0 | 13.2 | 48 | 30.8 | PASS | PASS | PASS | 44 |
| −10% Charge | 95 | −7.1 | 11.4 | 46 | 30.8 | PASS | PASS | PASS | 45 |
| −20% Charge | 95 | −6.7 | 24.7 | 40.3 | 30.8 | PASS | PASS | PASS | 48 |
| −30% Charge | 95 | −6.5 | 36.2 | 33.2 | 30.8 | PASS | PASS | PASS | 49 |
| −40% Charge | 95 | −6.3 | 51.7 | 16.3 | 30.8 | FAIL | PASS | PASS | 52 |

Figure 7:
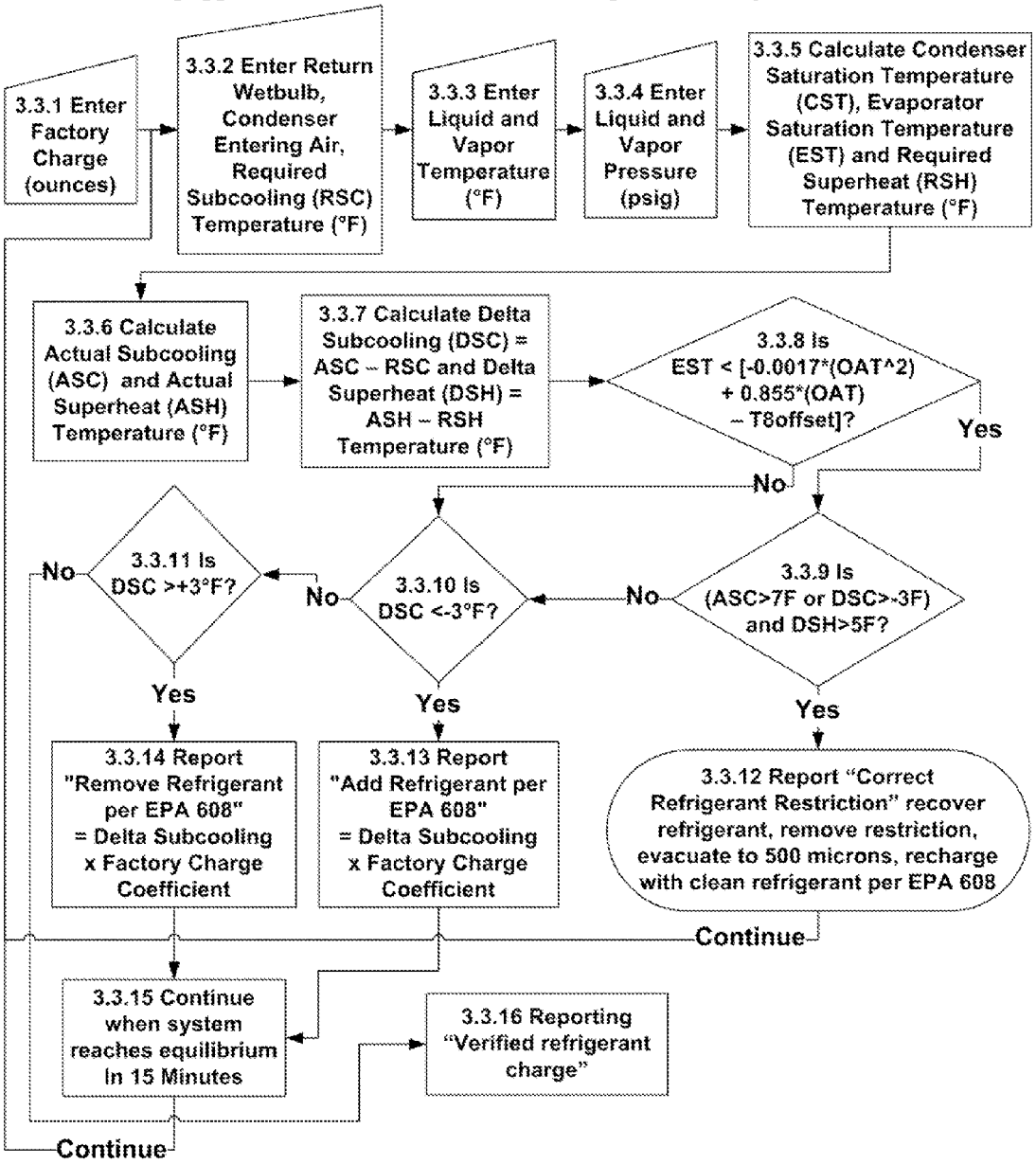
FIG. 7 shows flow chart to distinguish refrigerant restrictions from under-charge for TXV equipped air conditioners or heat pumps in cooling mode, according to the present invention.

FIG. 7 illustrates a method to differentiate refrigerant restrictions from under-charge for TXV equipped air conditioners or heat pumps in cooling mode. The method includes:

entering factory charge (ounces);

entering return wetbulb, condenser entering air and Required Subcooling (RSC) (° F.);

entering liquid and vapor line temperature (° F.);

entering liquid and vapor line pressure (psig);

calculating Condenser Saturation Temperature (CST), Evaporator Saturation Temperature (EST) and Required Superheat (RSH) (° F.);

calculating Actual Subcooling (ASC) and Actual Superheat Temperature (ASH) (° F.);

calculating Delta Subcooling (DSC)=ASC−RSC;

calculating Delta Superheat (DSH)=ASH−RSH Temperature (° F.);

if:

initial EST>[−0.0017*(OAT^2)+0.855*(OAT)−$T8_{offset}$]; and

ASC>7 deg F.; or

DSC>−3 deg F., and

DSH>5 deg F., where:

if SEER>=13, then T8offset=35.043;

if 10<=SEER<13, then T8offset=34.043; and if SEER<10, then T8offset=33.043;

then, reporting "Correct Refrigerant Restriction";

recovering refrigerant;

removing restriction;

evacuating to 500 microns;

recharging; and continuing testing;

otherwise:

if DSC<−3 deg F.:

reporting "Add Refrigerant per EPA 608"=DSC x Factory Charge Coefficient;

and continuing when system reaches equilibrium in 15 minutes;

if DSC>+3 deg F.:

reporting "Remove Refrigerant per EPA 608"=DSC x Factory Charge; and continuing when system reaches equilibrium in 15 minutes;

if;

DSC<or =+3 deg F.; and

DSC>or =−3 deg F., then:

reporting "Verified refrigerant charge"; and ending testing;

end.

I claim:

1. A method for improving air conditioning system efficiency, the method comprising:

expanding temperature split and superheat tables into previously undefined values using laboratory test data;

looking up target superheat in the expanded superheat tables;

expanding the delta superheat tolerance when target superheat is low to avoid overcharging;

performing at least one correction to the air condition system selected from:

determining the presence of non-condensables in the air conditioning system by simultaneously evaluating four parameters: 1) superheat, 2) subcooling, 3) condenser saturation temperature minus condenser entering air temperature as a function of outdoor air temperature and condenser heat exchanger surface area as a function of SEER rating, and 4) evaporator saturation temperature as a function of outdoor air temperature and evaporator heat exchanger surface area as a function of SEER rating, and:

if non-condensables are present, then recovering refrigerant, removing non-condensables from the air conditioning system, evacuating to 500 microns, recharging, and continuing;

if non-condensables are not present, determining an estimate of refrigerant over-charge by simultaneously evaluating three parameters: 1) superheat, 2) subcooling, and 3) condenser saturation temperature minus condenser entering air temperature as a function of outdoor air temperature and condenser heat exchanger surface area as a function of SEER rating, and adjusting the refrigerant level based on the over-charge estimate; and determining the presence of restrictions in the air conditioning system by simultaneously evaluating four parameters: 1) superheat, 2) subcooling, 3) condenser saturation temperature minus condenser entering air temperature as a function of outdoor air temperature and condenser heat exchanger surface area as a function of SEER rating, and 4) evaporator saturation temperature as a function of outdoor air temperature and evaporator heat exchanger surface area as a function of SEER rating, and:

if restrictions are present, then recovering refrigerant, removing restrictions from the air conditioning system, evacuating to 500 microns, recharging, and continuing; and if restrictions are not present, determining an estimate of refrigerant under-charge by simultaneously evaluating three parameters: 1) superheat, 2) subcooling, and 3) evaporator saturation temperature as a function of outdoor air temperature and evaporator heat exchanger surface area as a function of SEER rating, and adjusting the refrigerant level based on the under-charge estimate.

2. The method of claim 1, further including processing test data using a computer program to distinguish non-condensables from refrigerant over-charge and refrigerant restrictions from refrigerant under-charge and obtain accurate refrigerant over-charge and accurate refrigerant under-charge diagnostics.

3. The method of claim 2, wherein processing test data comprises processing temperature measurement data.

4. The method of claim 3, wherein processing test data further comprises processing pressure measurement data.

5. The method of claim 3, wherein processing test data further comprises processing:

target superheat temperature;
return air wet bulb temperature;
return air dry bulb;
supply air wet bulb;
supply air dry bulb;
condenser air entering temperature;
refrigerant superheat vapor line temperature;
refrigerant superheat vapor line pressure;
refrigerant liquid line temperature;
refrigerant liquid line pressure; and
power input to the compressor, condenser fan, evaporator fan, and controls.

6. The method of claim 3, wherein processing test data further comprises processing:

target subcooling temperature;
return air wet bulb temperature;
return air dry bulb;
supply air wet bulb;
supply air dry bulb;
condenser air entering temperature;
refrigerant superheat vapor line temperature;
refrigerant superheat vapor line pressure;
refrigerant liquid line temperature;
refrigerant liquid line pressure; and
power input to the compressor, condenser fan, evaporator fan, and controls.

7. The method of claim 2, further comprising calculating whether the cooling system has proper airflow.

8. The method of claim 1, further including:

taking return wetbulb and condenser entering air temperatures (° F.);

calculating target superheat using the expanded empirical target superheat table (° F.);

if target superheat is less than or equal to 7° F. and greater than or equal to 2° F.:

reporting delta superheat tolerance lower limit=2° F. minus target superheat; and reporting delta superheat tolerance upper limit=12° F. minus target superheat.

9. The method of claim 1, wherein, for non-TXV systems, determining the presence of non-condensables in the air conditioning system comprises:

comparing Condenser Over Ambient (COA) temperature, Actual Subcooling (ASC) temperature, and Delta Superheat (DSH) temperature to thresholds;

if COA, ASC, and DSH all exceed their respective threshold, reporting the presence of non-condensables in the air conditioning system.

10. The method of claim 1, wherein, for TXV systems, determining the presence of non-condensables in the air conditioning system comprises:

comparing Condenser Over Ambient (COA) temperature, Delta Subcooling (DSC) temperature, and Delta Superheat (DSH) to thresholds;

if COA, DSC, and DSH all exceed their respective threshold, reporting the presence of non-condensables in the air conditioning system.

11. The method of claim 1, wherein, for Non-TXV systems, determining the presence of restrictions in the air conditioning system comprises:

comparing Evaporator Saturation Temperature (EST) temperature, Actual Subcooling (ASC), and Delta Superheat (DSH) to thresholds;

if EST, ASC, and DSH all exceed their respective threshold, reporting the presence of restrictions in the air conditioning system.

12. The method of claim 1, wherein, for TXV systems, determining the presence of restrictions in the air conditioning system comprises:

comparing Evaporator Saturation Temperature (EST) temperature, Actual Subcooling (ASC), Delta Subcooling (DSC) temperature, and Delta Superheat (DSH) to thresholds;

if EST, ASC, DSC, and DSH all exceed their respective threshold, reporting the presence of restrictions in the air conditioning system.

13. A method for method verifying and restoring the proper operation of a cooling system, the method comprising:

verifying proper airflow of the cooling system using the expanded temperature split table;

verifying proper superheat of the cooling system using the expanded superheat table and the delta superheat tolerance when target superheat is less than or equal to 7 degrees F. and greater than or equal to 2 degrees F. to avoid overcharging;

distinguishing non-condensables from refrigerant overcharge to determine an actual over-charge by simultaneously evaluating three parameters: 1) superheat, 2) subcooling, and 3) condenser saturation temperature minus condenser entering air temperature as a function of outdoor air temperature and condenser heat exchanger surface area as a function of SEER rating;

distinguishing refrigerant restrictions from under-charge to determine an actual under-charge by simultaneously evaluating three parameters: 1) superheat, 2) subcooling, and 3) evaporator saturation temperature as a function of outdoor air temperature and evaporator heat exchanger surface area as a function of SEER rating;

verifying proper refrigerant charge of the cooling system;

verifying proper enthalpy of the cooling system;

verifying proper energy efficiency ratio of the cooling system;

computing a refrigerant charge correction from one of the actual over charge and the actual under-charge; and correcting the refrigerant charge base on the computed correction.

14. The method of claim 13, wherein creating a prediction of an amount of a refrigerant to add or remove from the cooling system comprises predicting an adjustment to refrigerant level optimized for cooling capacity.

15. The method of claim 13, wherein creating a prediction of an amount of a refrigerant to add or remove from the cooling system comprises predicting an adjustment to refrigerant level optimized for enthalpy, energy efficiency, and energy efficiency ratio (EER).

16. The method of claim 13, further comprising:

collecting a set of setup verification information relating to items selected from a list consisting of:

installation quality control; and energy efficiency performance;

recording the setup verification information in a database; and providing the setup information responsive to internet based requests from a plurality of users selected from a list consisting of dealers, distributors and customers.

17. A method for ensuring correct setup of a cooling system, the method comprising:

confirming a presence of a Thermostatic Expansion Valve (TXV);

creating a set of measurements comprising:

a measurement of refrigerant subcooling liquid line temperature; and a measurement of refrigerant subcooling liquid line pressure;

distinguishing non-condensables from refrigerant over-charge to determine an actual over-charge;

distinguishing refrigerant restrictions from under-charge to determine an actual under-charge;

when at least one of the non-condensables and the restrictions are present, correcting at least one of the non-condensables and restrictions;

when the non-condensables and the restrictions are not present:

predicting an amount of refrigerant to add or remove based on one of the actual over-charge and the actual under-charge; and adjusting the amount of refrigerant in the cooling system based on the prediction.

18. The method of claim 17 wherein the cooling system comprises a subsystem selected from a list consisting of:

a split-system air conditioning system;

a packaged air conditioning system; and a heat pump system capable of operating in a cooling mode.

19. The method of claim 17 wherein the prediction is optimized for cooling capacity.

20. The method of claim 17 wherein the prediction is optimized for energy efficiency.

* * * * *